US007255156B2

(12) United States Patent
Calton et al.

(10) Patent No.: US 7,255,156 B2
(45) Date of Patent: Aug. 14, 2007

(54) COMPACT HEAT EXCHANGER WITH HIGH VOLUMETRIC AIR-FLOW

(75) Inventors: Dean Calton, La Vernia, TX (US); Henry Mark, Philadelphia, PA (US)

(73) Assignee: PowerCold Corporation, Philadelphia, PA (US)

( * ) Notice: Subject to any disclaimer, the term of this patent is extended or adjusted under 35 U.S.C. 154(b) by 297 days.

(21) Appl. No.: 10/894,715

(22) Filed: Jul. 20, 2004

(65) Prior Publication Data

US 2005/0039892 A1 Feb. 24, 2005

Related U.S. Application Data

(63) Continuation of application No. PCT/US03/24665, filed on Aug. 4, 2003.

(60) Provisional application No. 60/400,609, filed on Aug. 2, 2002.

(51) Int. Cl.
*F28D 5/02* (2006.01)

(52) U.S. Cl. ..... 165/115; 165/122; 165/117

(58) Field of Classification Search ..... 165/67, 165/115, 117, 162, 163
See application file for complete search history.

(56) References Cited

U.S. PATENT DOCUMENTS 5,046,331 A 9/1991 O'Neal et al.
5,088,550 A * 2/1992 Tippman et al. ..... 165/117
5,501,269 A * 3/1996 Jenkins ..... 165/110
5,787,722 A 8/1998 Jenkins

OTHER PUBLICATIONS

International Search Report for PCT/US03/24665; dated Jan. 5, 2004.

* cited by examiner

*Primary Examiner*—Allen J. Flanigan
(74) *Attorney, Agent, or Firm*—Volpe and Koenig, P.C.

(57) ABSTRACT

A heat exchanger including a housing having a base and defining an interior. A plurality of coils are located in the interior of the housing and are arranged to extend upwardly from the base to define a coil depth. A blower is adapted to move air through the plurality of coils in a direction of the coil depth. A water distribution system is preferably located around a circumferential periphery of the plurality of coils to spray water on an outer surface of the plurality of coils along substantially the entire coil depth thereof. At least one air inlet opening is located in the housing to allow airflow across the plurality of coils. Additional embodiments of improved heat exchangers are disclosed herein.

17 Claims, 30 Drawing Sheets

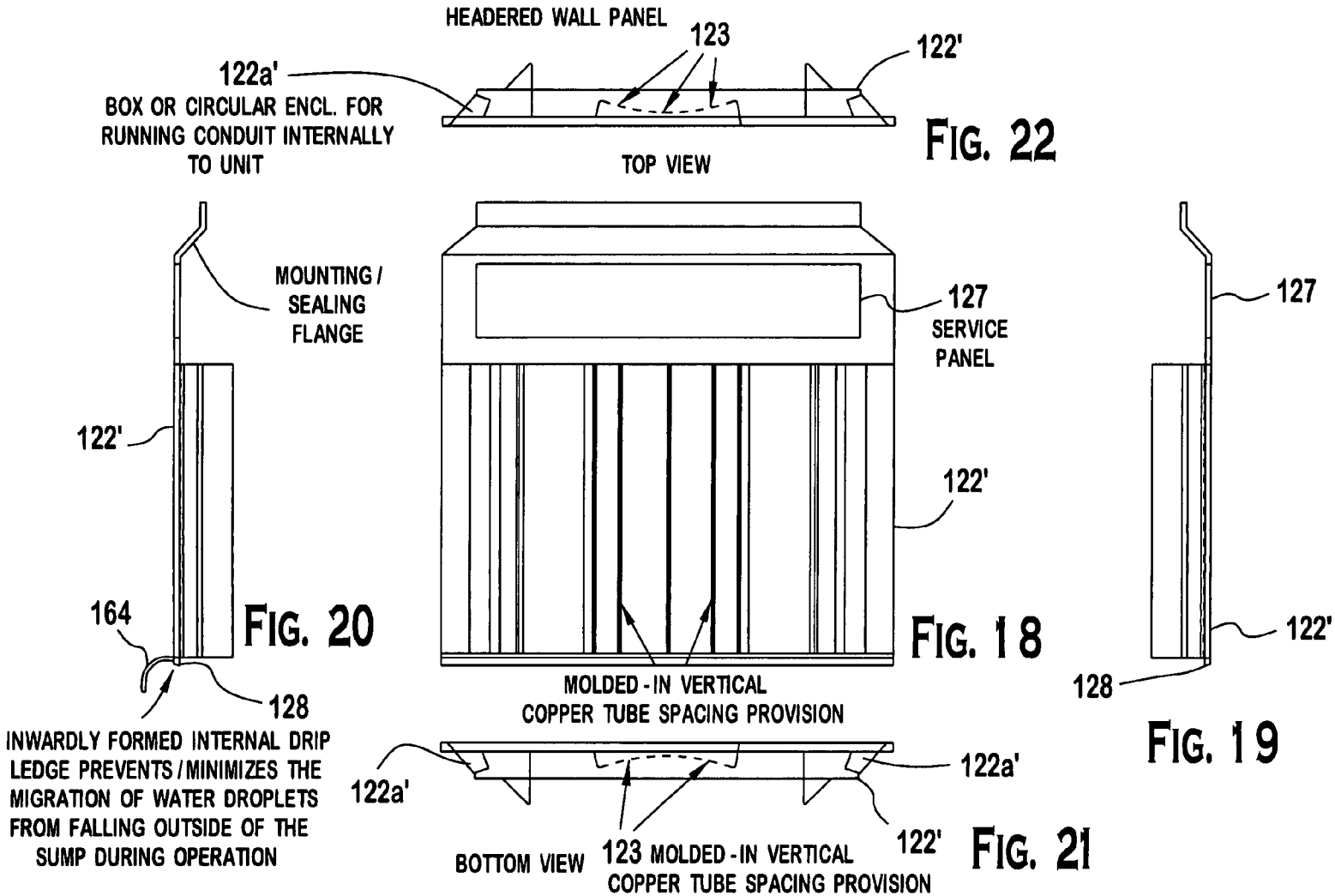
127
122'
128
FIG. 19
HEADERED WALL PANEL
123
TOP VIEW
122'
FIG. 22
127
SERVICE PANEL
122'
FIG. 18
MOLDED-IN VERTICAL COPPER TUBE SPACING PROVISION
122a'
122'
123 MOLDED-IN VERTICAL COPPER TUBE SPACING PROVISION
BOTTOM VIEW
122a'
FIG. 21
122a'
BOX OR CIRCULAR ENCL. FOR RUNNING CONDUIT INTERNALLY TO UNIT
MOUNTING / SEALING FLANGE
122'
164
128
FIG. 20
INWARDLY FORMED INTERNAL DRIP LEDGE PREVENTS / MINIMIZES THE MIGRATION OF WATER DROPLETS FROM FALLING OUTSIDE OF THE SUMP DURING OPERATION

NON-HEADER WALL PANEL
123
122
TOP VIEW 127
122
MOLDED-IN VERTICAL
COPPER TUBE SPACING PROVISION 127
122
128

122
122a'
123 MOLDED-IN VERTICAL
COPPER TUBE SPACING PROVISION
BOTTOM VIEW
122a'

MOUNTING/
SEALING
FLANGE
122
128
INWARDLY FORMED INTERNAL DRIP
LEDGE PREVENTS/MINIMIZES THE
MIGRATION OF WATER DROPLETS
FROM FALLING OUTSIDE OF THE
SUMP DURING OPERATION

TOP VIEW

FRONT VIEW

RIGHT SIDE VIEW

TOP VIEW
DEPICTING WALL PANEL ASSEMBLY
PRIOR TO MOUNTING OF FAN / SPRAY
HEADER ASSEMBLY

2 CIRCUIT - 5 FT. STD PIPE CONNECTION LOCATION DIAGRAM

CUT-AWAY VIEW

FIG. 49B
REVISED WALL DRAWING
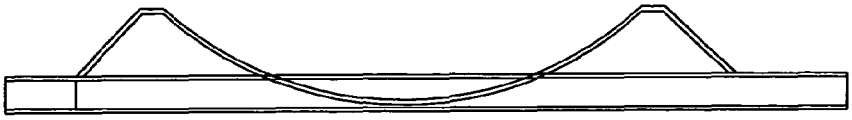
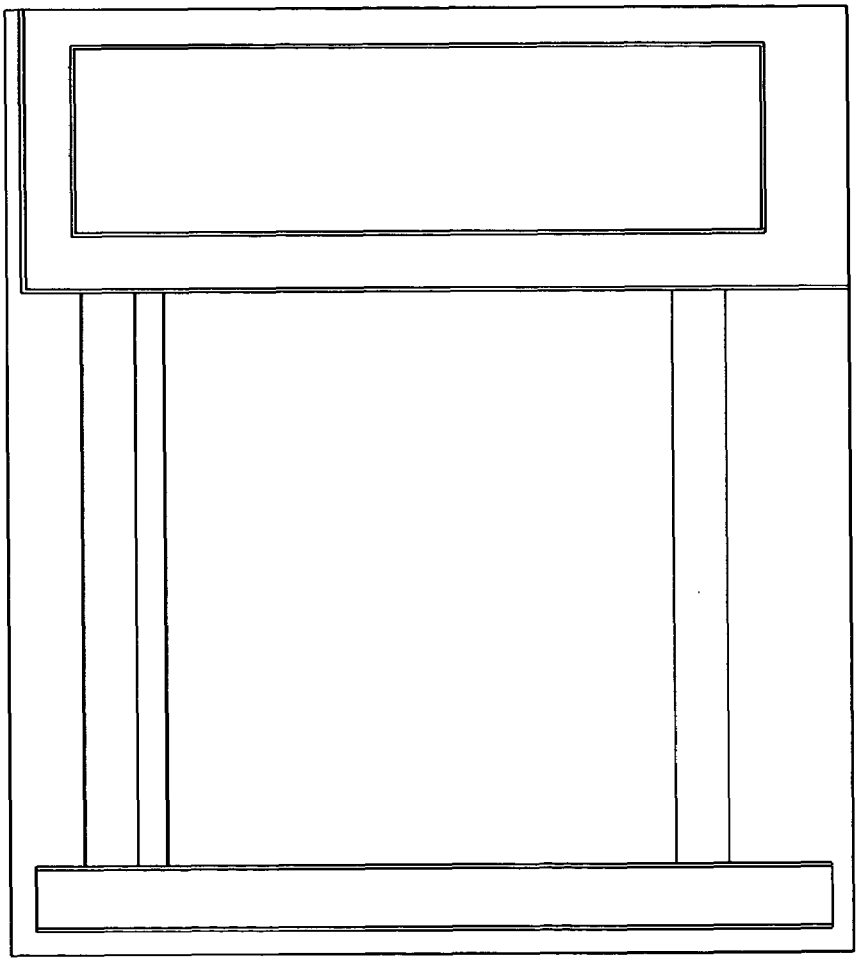
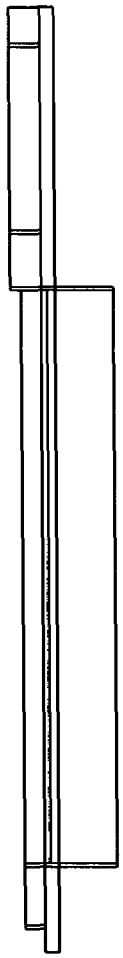
FIG. 49A
FIG. 49C

DETAIL B
METHOD OF CONTAINING
COILS SUB - ASSEMBLY
DETAIL A

COMPACT HEAT EXCHANGER WITH HIGH VOLUMETRIC AIR-FLOW

CROSS REFERENCE TO RELATED APPLICATION

This application claims priority from and benefit of U.S. provisional patent application 60/400,609, filed Aug. 2, 2002, and entitled "Compact Heat Exchanger With High Volumetric Air-flow," which is hereby incorporated by reference herein as if fully set forth in its entirety.

BACKGROUND

The present invention relates to an improved heat exchanger coil which utilizes evaporative cooling, and more particularly, to a condenser unit that provides for a higher volumetric airflow within the heat exchanger with reduced pressure drop to increase the heat exchanger efficiency.

Heat exchangers which are commonly used as condensing units in refrigeration systems, such as for industrial air conditioning, are known. One such heat exchanger which is described in detail in U.S. Pat. Nos. 5,501,269 and 5,787,722, which are assigned to the assignee of the present invention and are incorporated herein by reference as if fully set forth, utilize evaporative cooling of spiral coils located within a heat exchanger housing. Water is sprayed onto the heat exchange coils solely from above or from the top and through the middle and travels downwardly through the coils providing evaporative cooling. At the same time, air is drawn through the pathways located in the outer housing walls to the base of the heat exchange unit and then upwardly through the spiral coils by a fan or blower to increase the evaporative cooling efficiency.

To provide for maximum heat transfer, it is desirable to provide as much surface area as possible for each of the spiral cooling coils while still allowing sufficient space for the travel of water droplets downwardly through the spiral coils as well as upward airflow. Using these known parameters, the coil spacing has been maximized to provide efficient cooling for the refrigerant carried in the coils. Closer radial spacing of the coils results in a higher pressure drop across the coils for a given fan or blower airflow rating which ultimately leads to reduced efficiency beyond a point of maximization.

It would be desirable to provide further improvements in the efficiency of such heat exchanger units to increase the cooling capacity of the heat exchanger as well as reduce cooling costs.

SUMMARY

Briefly stated, one embodiment of the present invention is directed toward a heat exchanger including a housing having a base and defining an interior. A plurality of coils are located in the interior of the housing and are arranged to extend upwardly from the base to define a coil depth. A blower is adapted to move air through the plurality of coils in a direction of the coil depth. A water distribution system is configured to spray water onto the plurality of coils. At least one air inlet opening is located in the housing to allow airflow across the plurality of coils. A coil alignment mechanism is located on the base for positioning the plurality of coils thereon. The number of the plurality of coils is adjustable so that a desired amount of cooling is provided by the heat exchanger.

In another aspect, the present invention is directed to a heat exchanger including a housing having a base and defining an interior. A plurality of coils are located in the interior of the housing and are arranged to extend upwardly from the base to define a coil depth. A blower is adapted to move air through the plurality of coils in a direction of the coil depth. A water distribution system is located around a circumferential periphery of the plurality of coils to spray water on an outer surface of the plurality of coils along substantially the entire coil depth thereof. At least one air inlet opening is located in the housing to allow airflow across the plurality of coils.

In another aspect, the present invention is directed to a heat exchanger including a housing having a base and defining an interior. A plurality of coils are located in the interior of the housing and are arranged to extend upwardly from the base to define a coil depth. A blower is adapted to move air through the plurality of coils in a direction of the coil depth. A water distribution system is configured to spray water onto the plurality of coils. A plurality of air inlet openings are located in the housing at various locations to allow ambient air to contact the plurality of coils generally along the entire coil depth to reduce an airflow pressure drop of the heat exchanger.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 18 is a side elevational view of a headered sidewall panel for the compact heat exchanger of FIG. 12.

FIG. 19 is a right side elevational view of FIG. 18.

FIG. 20 is a left side elevational view of FIG. 18.

FIG. 21 is a bottom view of FIG. 18.

FIG. 22 is a top view of FIG. 18.

FIG. 23 is a left side elevational view of FIG. 23.

FIGS. 49A-49C illustrate an alternate embodiment of a heat exchanger housing that is streamlined for attachment to the frame.

DETAILED DESCRIPTION OF THE PREFERRED EMBODIMENTS

Figure 1:
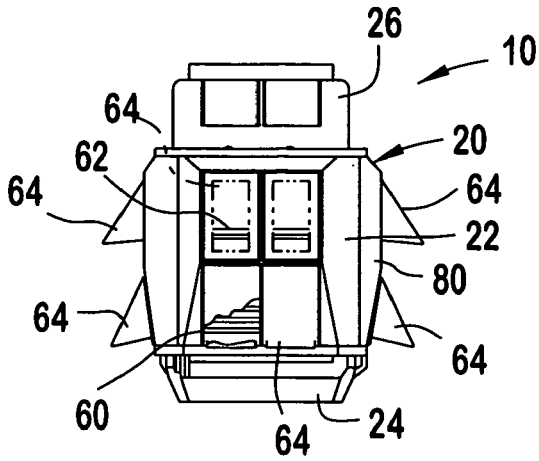
FIG. 1 is a front elevational view of a compact heat exchanger in accordance with the present invention with three of the air intake vents being shown in phantom lines.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the heat exchanger and designated parts thereof. The terminology includes the words above specifically mentioned, derivatives thereof and words of similar import. The word "a" as used in the claims and in the corresponding portions of the specification means "at least one."

Referring to FIGS. 1-43, first and second preferred embodiments of an improved heat exchanger are shown and generally designated as 10 and 110, respectively. Briefly stated, the heat exchangers 10, 110 of the present invention preferably allow for the easy adjustment of the number of coils therein to allow heat exchangers to be produced for various loads while using a single standard housing 20. This simplifies the production of heat exchangers for different cooling loads and facilitates the retroactive adjustment of cooling capacity or the addition of further cooling circuits. Additionally, the heat exchangers of the present invention preferably perform at higher capacity than conventional heat exchangers without increasing fan horsepower.

Many of the features of the heat exchangers 1, 110 of the present invention are similar and operate in a generally similar fashion. For simplicity, the first preferred heat exchanger 10 will be described and, thereafter, only differences between the first preferred heat exchanger and the second preferred heat exchanger 110 will be discussed. Accordingly, it is understood that those features discussed in connection with any one of the preferred embodiments of the heat exchangers 10, 110 will operate generally the same in the remaining embodiments unless otherwise described.

Figure 2:
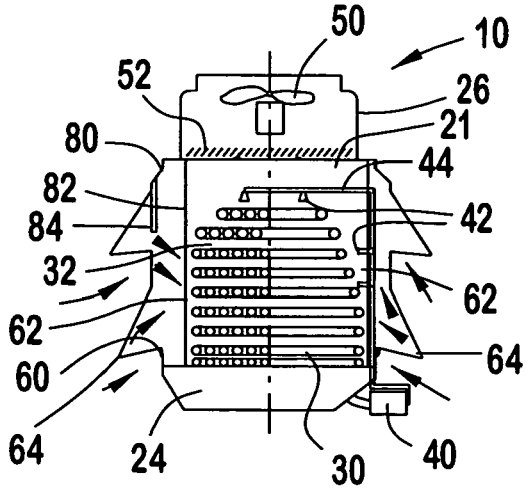
FIG. 2 is a cross-sectional view, which is partially broken away and shown in schematic form, of the compact heat exchanger of FIG. 1.

Referring to FIGS. 1 and 2, the first preferred embodiment of the heat exchanger 10 includes a housing 20 having a base 24, also referred to as a sump, a top enclosure 26, and at least one sidewall portion 22. The sidewall portion 22 preferably includes an inner sidewall 82 and an outer sidewall 84, as shown in FIG. 2. The housing 20 defines an interior 21 that is preferably bounded by the inner sidewall 82. Air intake openings 60, 62 are provided through the inner and outer sidewalls 82, 84 of the housing 20. To reduce the total airflow pressure drop of the system, the airflow openings 60 are located in the inner sidewall 82 along generally the entire flow length adjacent to coils 30 (further described below). Sewer inlet openings 62 are also provided in the outer sidewall 84.

To prevent debris and light from directly entering the housing 20, intake vent covers 64 are preferably located over the opening 62 in the outer sidewall of the housing 20. Three of the four vent covers 64 shown in the front face of the housing 20 in FIG. 1 have been removed to show the opening 62 in the outer sidewall 84 and the opening 60 spaced along the height (i.e., along the coil depth CD, further described below) of the coils 30 in the inner housing sidewall 82.

The intake vent covers 64 may be formed of plastic or any other type of material that is suitable for outdoor use. These may be attached by an internal clip or secured with a minimum of mechanical fasteners. Preferably a screen element in the form of a mesh or removable filter is attached the intake hoods 64 to preclude the egress of airborne particulates into the sump 24.

Figure 3:
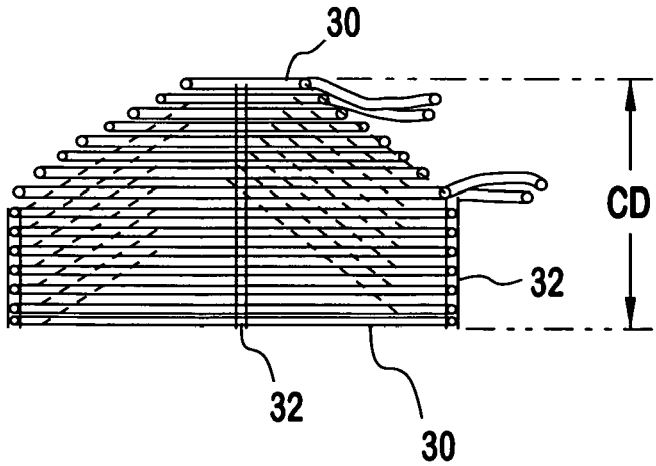
FIG. 3 is an elevational view of the heat exchanger coils used in the compact heat exchanger in accordance with the present invention.
Figure 7:
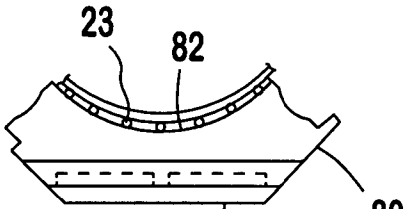
FIG. 7 is a top view of the housing segment shown in FIG. 4.

As best shown in FIG. 2, the coils 30 are located in the interior 21 of the housing 20 and are arranged to extend upwardly from the base 24 to define a coil depth "CD" (shown in FIG. 3). The cooling coils 30 are preferably formed of a smooth walled material, such as cooper, aluminum, or a suitable polymeric material. However, other materials and a thinned, corrugated, or other type of tube construction can be utilized, without departing from scope of the present invention. As best shown in FIG. 3, it is preferable that the coils 30 include a plurality of stacked, spiral coils that are generally conically shaped. The spirals are preferably of the Archimedes type with uniform tube spacing or may be of the LogA R/MC type. Stacked flat coils can also be used with the heat exchanger of the present invention.

The coils 30 preferably carry a refrigerant such as CFC, HFC, or ammonia and preferably act as an condenser in an air conditioning system, or carry a liquid such as water or a water soluble aqueous mixture of water and glycol, or any other type of heat exchange medium capable of acting as a fluid cooling medium wherein the refrigerant does not undergo a state change during operation. The heat exchanger may also incorporate coils 30 including two or more cooling circuits carrying multiple types of refrigerant that are individually circuited to act as a combination condenser and fluid cooler. The coils 30 may include at least one coil having a different diameter and/or a different spacing between vertically adjacent coils than the remaining coils.

A blower 50 is adapted to move air through the plurality of coils 30 in a direction of the coil depth CD. The blower 50 is preferably located within the top enclosure 26. A moisture recovery device 52 is preferably incorporated into or attached onto the housing 20 to generally prevent water from being blown out of the housing 20 when water droplets are drawn up through the heat exchanger 10 by the blower 50.

The moisture recovery device 52 can be in form of a series of baffles which force the airflow to make one or more turns such that water droplets are prevented from traveling upwardly through the moisture recovery device 52. Referring to FIG. 2, a preferred water distribution system (collectively shown by components 40, 42, 44) is adapted to spray water onto the coils 30.

Preferably, a pump 40 draws water from the base 24 and pumps it to a plurality of spray nozzles 42 located above and/or along the entire depth CD of the coils 30. The pump 40 can be located externally or preferably internally in the sump 24. Preferably, the spray nozzles 42 are located around a circumferential periphery of the plurality of coils 30 to spray water on an outer surface of the plurality of coils 30 along the entire coil depth CD thereof.

The water distribution system 52 benefits from the preferred advantageous double wall heat exchanger housing 82, 84 which defines a passage therebetween. Feed lines 44 for the cooling fluid of the water distribution system may be located within the passage between the internal and external sidewalls 82, 84. The nozzles 42 may be in form of slots in the distribution tubes 44 aligned with an air inlet opening 60 in the inner housing sidewall 82. Additionally, the nozzles 42 may be spray nozzles of various types connected to the feed lines 44 to provide a desired spray pattern.

At least one air inlet opening 60 is located in the housing 20 to allow airflow across the coils 30. Preferably, a plurality of air inlet openings 60 are located in the housing 20 at various locations to allow ambient air to contact the plurality of coils 30 generally along the entire coil depth CD to reduce an airflow pressure drop of the heat exchanger. "Ambient air" as used in the claims is defined to include "air which is in the passage between the inner and outer sidewalls 82, 84 as well as air that is in the intake vent cover 64."

Preferably, the airflow openings 60 in the inner sidewall 82 are symmetrically arranged around the periphery of the coils 30 and are spaced evenly throughout the coil depth CD. However, non-symmetric arrangements may also be provided and the sizes and spacing of the opening 60 may be varied to balance the airflow and pressure drop across the entire coil assembly 30.

By allowing ambient air to contact the coils 30 along the entire coil depth CD, the heat exchanger experiences increased airflow through the coils 30 and a reduced total airflow pressure drop across the coils 30. This increased airflow also increases cooling since the air drawn through the unit evaporatively cools the water. The increased airflow provides the benefit of more air being drawn through the unit per given horsepower which increases the total heat rejected by the system into the air stream with no increase in operating costs. It is believed that the system efficiency can be improved by ten percent or more utilizing the heat exchangers of the present invention.

Figure 8:
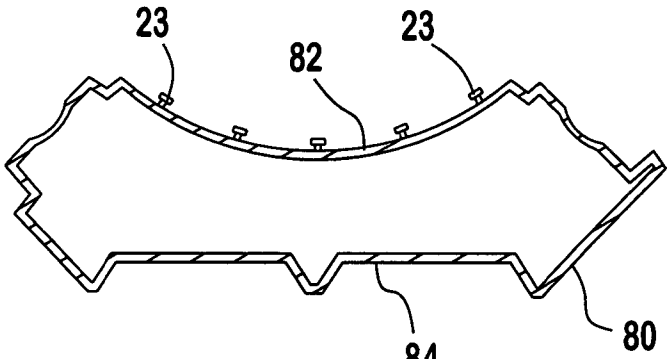
FIG. 8 is a cross-sectional view of the housing segment taken along line A-A in FIG. 4.
Figure 8A:
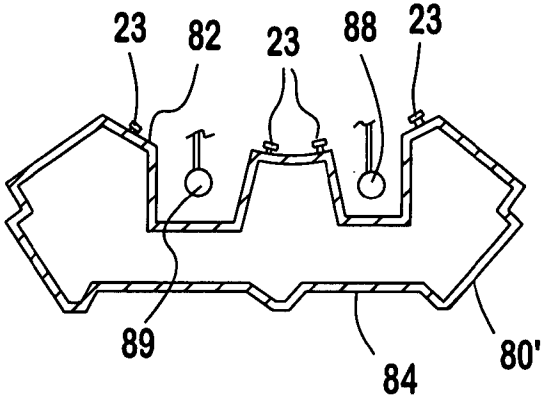
FIG. 8A is a cross-sectional view similar to FIG. 8 of a headered housing segment, showing the coil inlet and outlet headers located in the wall recesses.
Figure 5:
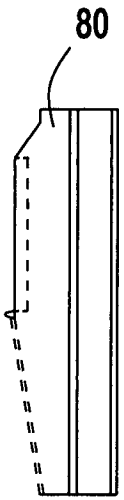
FIG. 5 is a right side elevational view of the quarter segment of the housing segment shown in FIG. 4.
Figure 4:
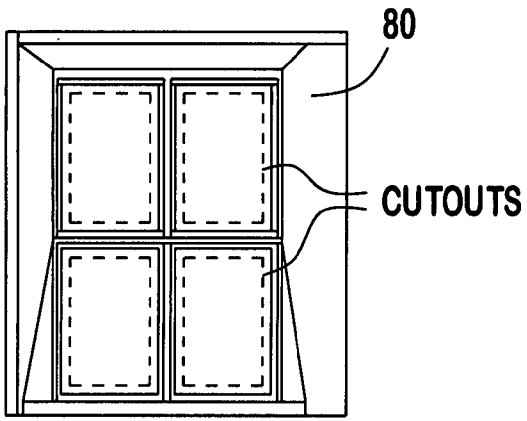
FIG. 4 is an elevational view of a quarter segment of the housing wall for the compact heat exchanger in accordance with the present invention.
Figure 6:
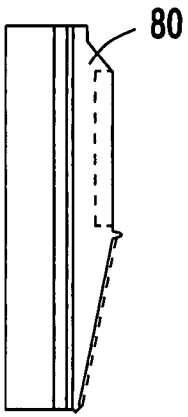
FIG. 6 is a left side elevational view of the housing section shown in FIG. 4.

Returning again to the preferred construction of the heat exchanger housing 20, as shown in detail in FIGS. 4-8 and 8A, the housing sidewall portion 22 is preferably formed by four sidewall segments 80, 80' which are joined together. One segment 80' is preferably a headered sidewall segment that has provisions for inlet and outlet connecting manifolds or headers 88, 89 (which are illustrated in FIG. 8A to show the relative positions) used to connect the coils 30. As shown in detail in FIGS. 7 and 8, the sidewall segments 80 include both the inner sidewall 82 and the outer sidewall 84. The sidewall segment 80 is preferably formed of a polymeric material and may be molded. Cut outs 60 and 62 are made in the inner and outer sidewalls 82, 84, respectively.

Four of the segments 80 are joined to form the sidewall portion 22 of the housing 20. The segments 80 may be connected together via mechanical fasteners, adhesive, welding, or a combination thereof, or through other appropriate means depending upon the material utilized to form the segments 80. Preferably the inner diameter of the inner wall 82 is slightly greater than the outside diameter of the coils 30. For additional control of coil spacing, longitudinal bumps 23 may be provided on the inner sidewall 82. The height of the housing sidewall portion 22 can be varied depending upon the height of the coils 30. Preferably, the housing 20 is made of a corrosion resistant material, which is also resistant to ultra-violet light, ozone, and other external factors since the heat exchangers 10, 110 are intended for outdoor use. The housing 20 may also be coded with a protective material or chemical treated to enhance its properties.

Figure 10:
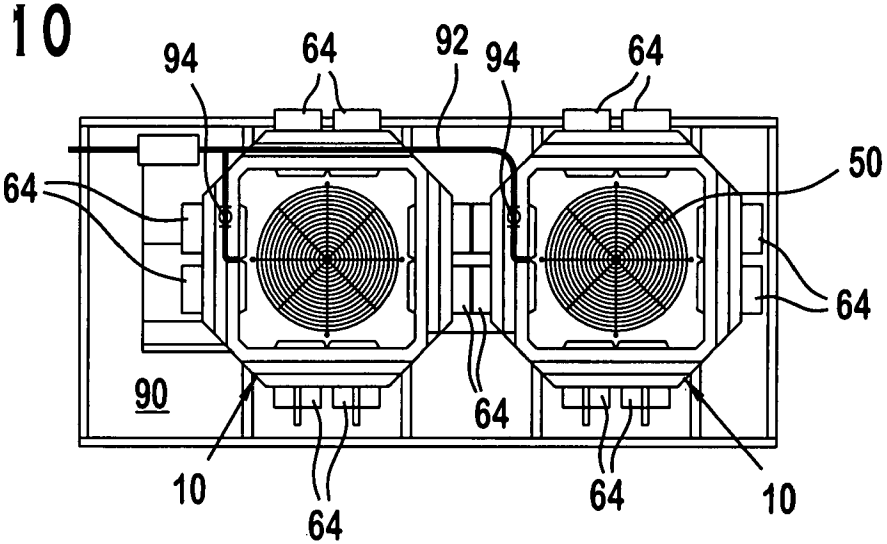
FIG. 10 is a top plan view of the arrangement shown in FIG. 9.
Figure 9:
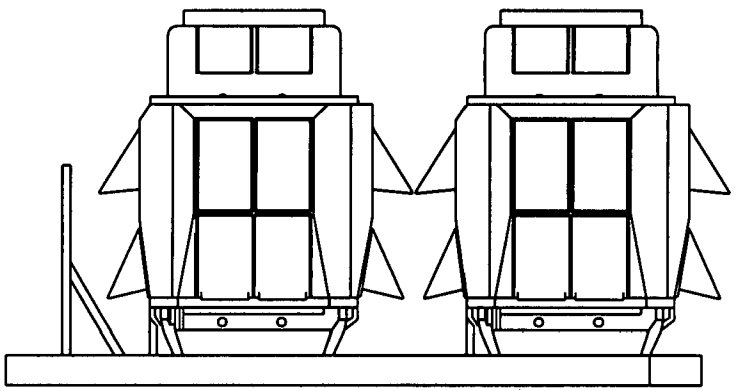
FIG. 9 is a front elevational view of two compact heat exchangers connected in parallel for a high capacity heat exchanger arrangement.
Figure 11:
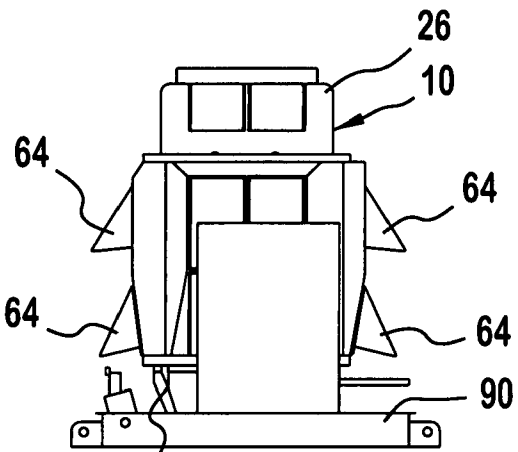
FIG. 11 is a left side elevational view of the arrangement of two heat exchangers shown in FIG. 9.
Figure 12:
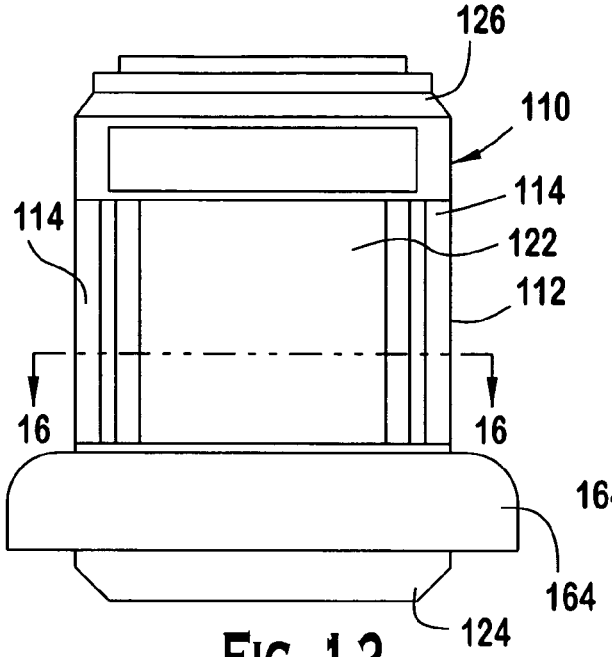
FIG. 12 is a front elevational view of a second preferred embodiment of a compact heat exchanger in accordance with the present invention.

Referring now to FIGS. 9-11, a dual arrangement utilizing two compact heat exchangers 10 in accordance with the present invention is shown. The heat exchangers 10 may be located on a pallet 90 and may be connected together in parallel or in series with tubing 92, depending upon the particular application. Valves 94 may be provided to take one or more of the heat exchangers off-line depending on the cooling capacity required. Multiple units may be arranged in this manner to provide for ease of installation.

Referring to FIGS. 12-40, a second preferred embodiment of a heat exchanger 110 in accordance with the present invention is shown. The heat exchanger 110 preferably incorporates a plurality of flat wound coils 130 and uses a flat mandrel having internal grooves for mechanically forming the tubing and radial slots to contain the coil spacers 133 or 234 (further described below). The flat coils 130 minimize residual stress and preferably use uniform spacing.

A coil alignment mechanism 132 is preferably located on the base 124 for positioning the coils 130 thereon. The coil alignment mechanism 132 preferably includes a post structure 112 having a plurality of posts 114 which extend generally upwardly from the base 124. Each of the coils 130 is preferably connected to at least one of the posts 114 using a sliding engagement.

Figure 17:
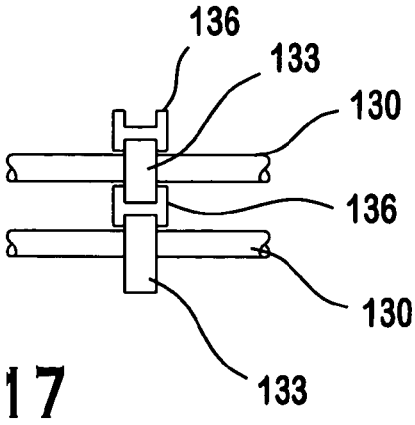
FIG. 17 is a partial elevational view of the ends of two stacked cooling coils with spacers located between adjacent coils.
Figures 23, 24, 25, 26, 27:
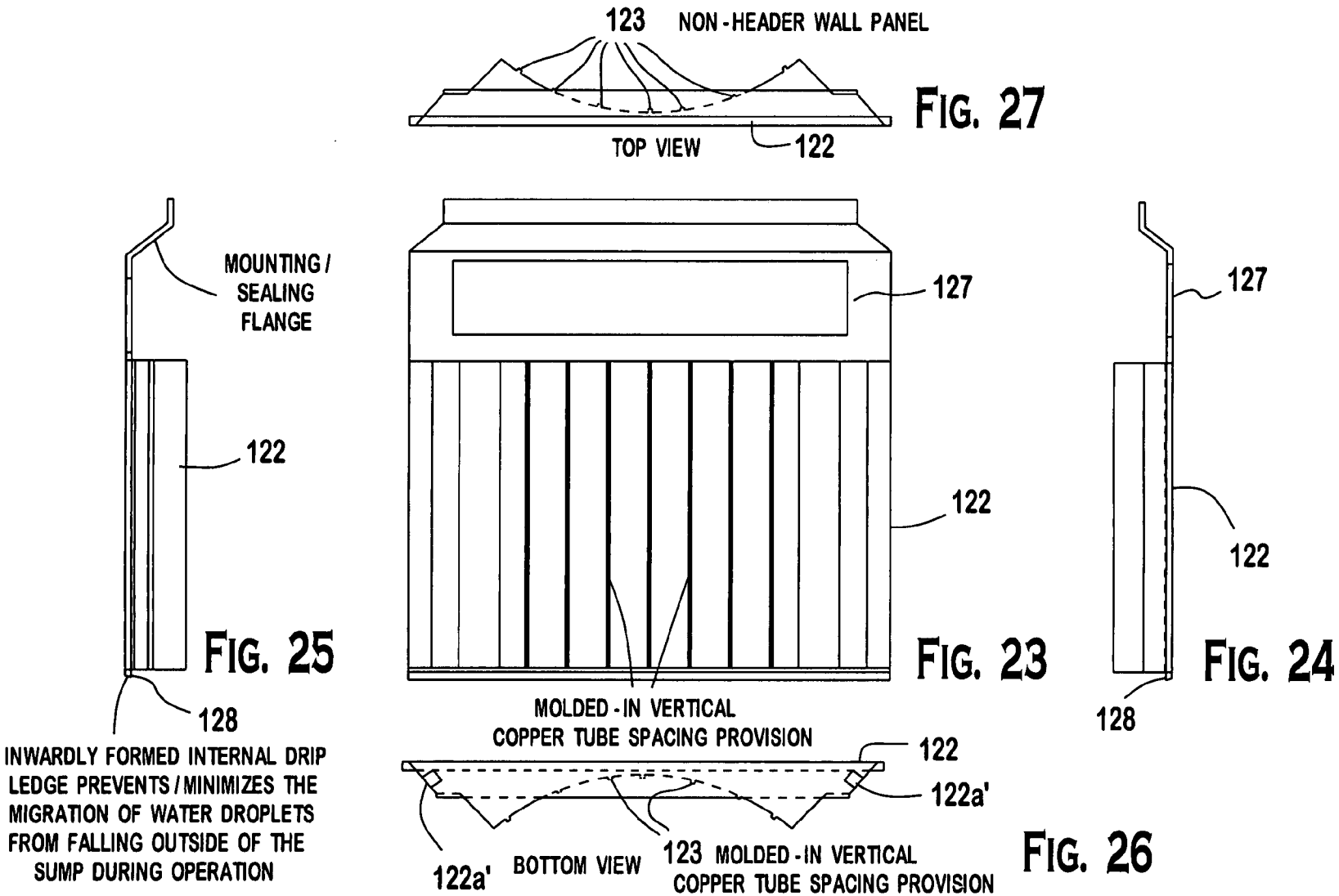
FIG. 23 is a side elevational view of a non-headered sidewall panel for the compact heat exchanger of FIG. 12.
FIG. 24 is a right side elevational view of FIG. 23.
FIG. 26 is a bottom view of FIG. 23
FIG. 27 is a top view of FIG. 23.
Figures 28, 29, 30, 31:
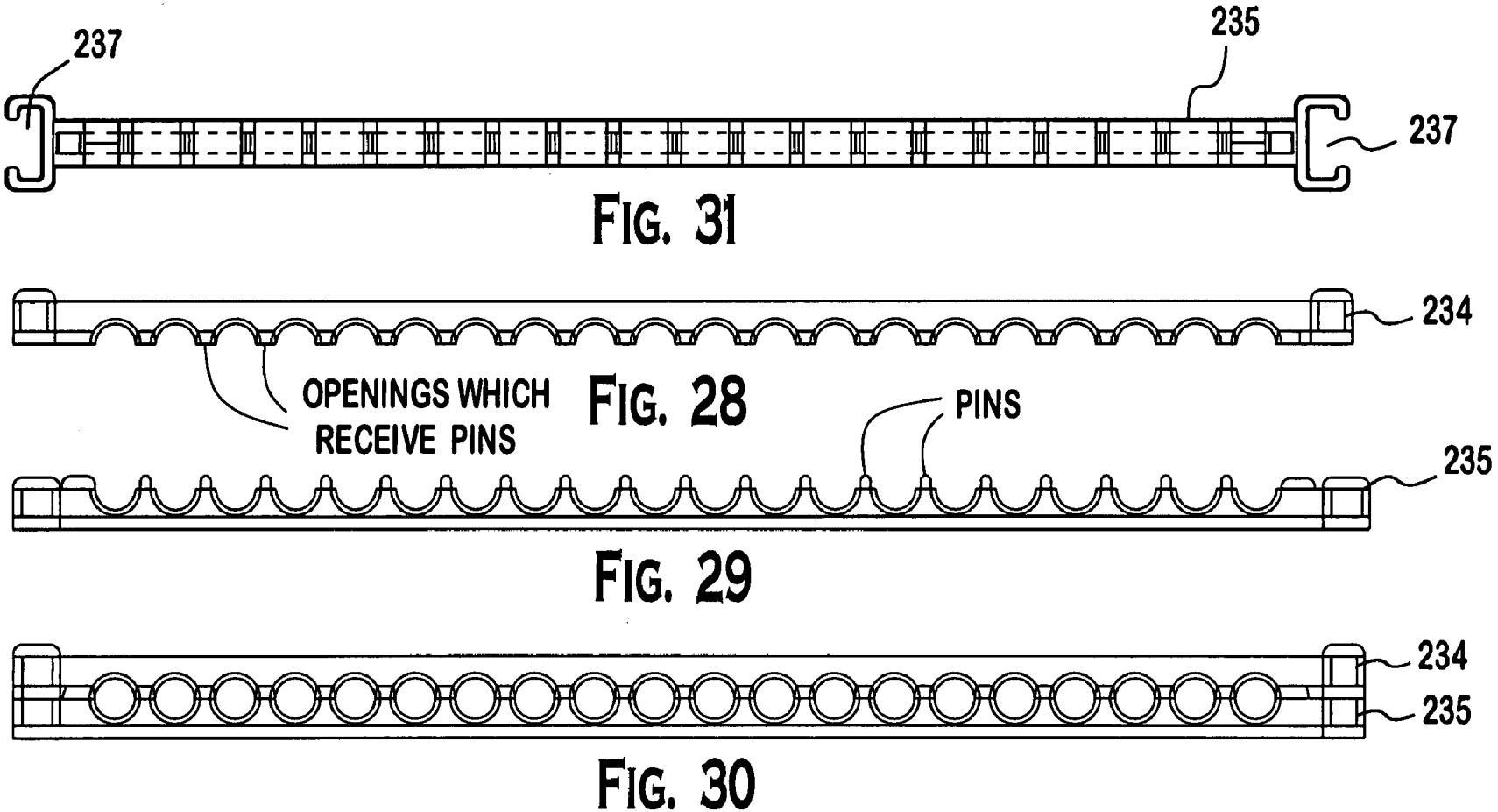
FIGS. 28 and 29 are side views of an alternate embodiment of the coil spacer halves, shown disassembled.
FIG. 30 is a side elevational view of the assembled coil spacer halves from FIGS. 28 and 29.
FIG. 31 is a top view of the spacer halve of FIG. 29.

Each of the coils 130 is preferably positioned over the base 124 of the housing 120 by the posts 114 such that the weight of the coils 30 is support substantially entirely by the base 124. The coils 130 are preferably located on a framework that engages at least one of the plurality of posts. The framework is preferable formed by two support bars 133, 134. The support bars 133, 134 preferably include coil tube supports 135 located thereon for maintaining the desired distance between the adjacent windings of the coil 130. The tube supports 135 preferably allow movement of the coil tubes due to thermal expansion and contraction while still maintaining their relative spacing. The maintenance of proper spacing enhances scale shedding. Each post 114 includes an inwardly facing channel 115, shown in FIG. 15, in which the ends of the support bars 133, 134 can be held, so that the coils 130 can be stacked to desired total coil height (or coil depth CD). The framework formed by the support bars 133, 134 preferably include spacers 136 that are located between vertically adjacent coils 130, as shown in FIG. 17. This allows easier assembly then prior known systems in which coils 130 are fastened in place using mechanical fasteners or welding or braising, and also allows for easier maintenance and/or replacement of one or more coils 130 for repair.

Alternatively, as shown in FIGS. 28-31, the framework can be formed by spacer bar halves 233, 234 which can be form fit (i.e., snapped) together to hold a coil 130 in place. The ends of one or both spacers halves 234, 235 preferably include a channel 237 through which vertical posts 114 can be installed to stack a plurality of the coils 130 together to form the stack heat exchanger coil 130. The openings in the spacer halves 233, 234 are preferably greater than the diameter of the preferred coil tubing to allow both circumferential and radial movement of the coil 130 due to thermal expansion and contraction. The spacer halves 233, 234 for the tubing serve only to contain the tubing in a manner that does not abrade or knick the tubing. The spacer halves 233, 234 are of sufficient thickness to provide for a smooth contact surface to preclude damage to the tubing.

Figure 43:
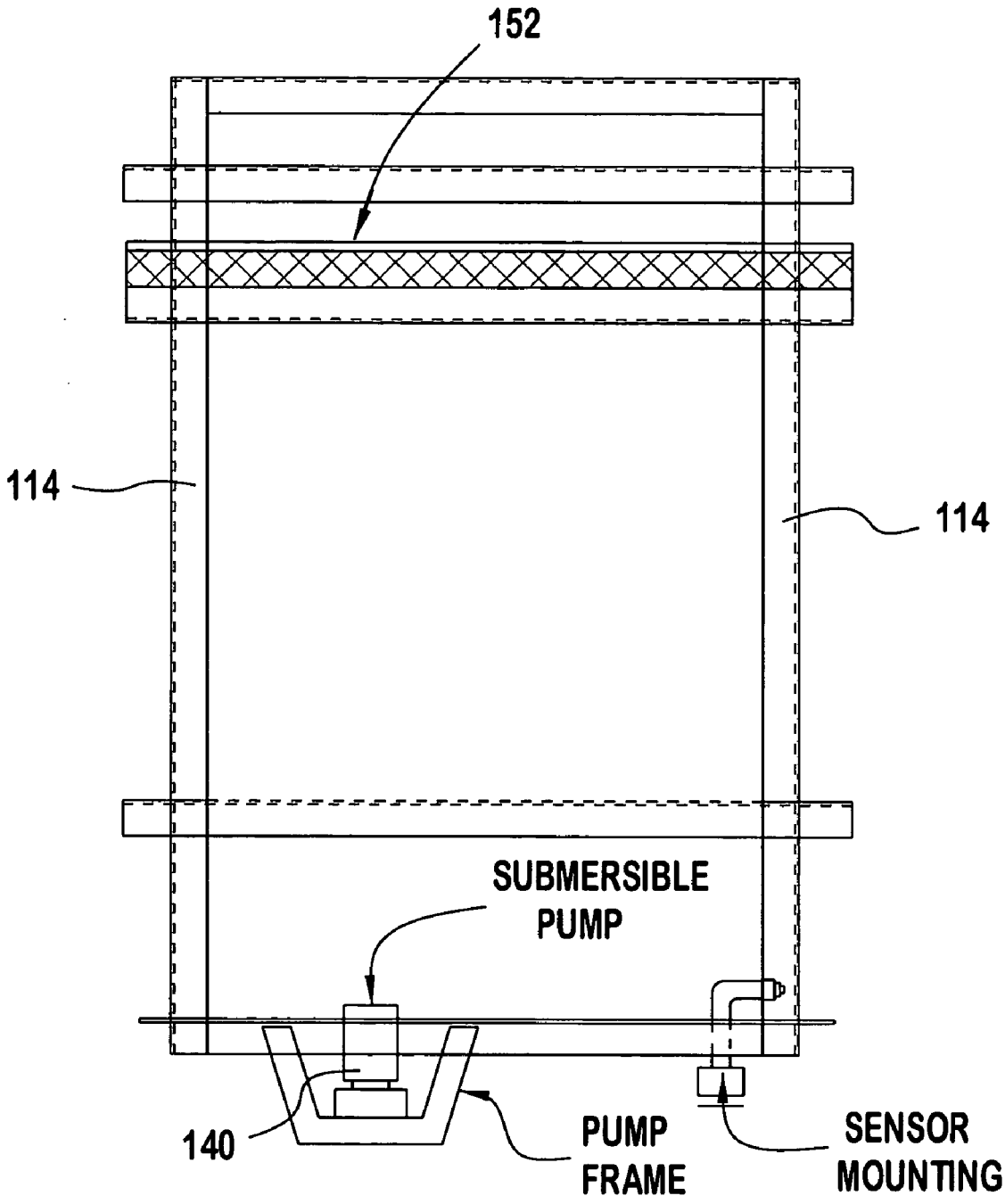
FIG. 43 is an elevational view of the four post frame with sensors mounted thereon.

The frame structure 112, including the posts 114, are preferably mounted to the base 124. The frame 112 preferably also allows for internal mounting of any desired components, such as a liquid level switch, sensors, sump heater, and devices to prevent scale formation, bacteria or fungal growth, algae, etc, as shown in FIG. 43. Housing sidewall panels 122, 122' can be attached to posts 114 and surround the coils 130. Unlike the prior known assemblies, the housing panels 122 are non-load bearing, and are provided to surround the cooling coils 130 to control the moisture flow for evaporative cooling and to resist outside weather and UV radiation.

Longitudinal bumps 123 are preferably located on the sidewall panels 122, 122' to keep the cooling coils 130 centered and spaced from the sidewall inner surface to maintain uniform spacing along the outer diameter of the coil 130 to provide for uniform airflow. As shown in FIGS. 18-22 and 23-27, two different types of side panels 122, 122' may be provided. The side panel 122' includes a headered panel 125 for pipe connections and recesses for locating the manifolds for piping connections.

Top and bottom cover pieces (which are not shown in the drawings, but generally the same size of the inner housing wall recesses) are located above and below the manifold connections to prevent airflow bypassing the coils 130. Locating the tubing manifolds (or headers) in the enclosure provides protection for the manifold as well as some additional heat transfer area.

The side panel 122 does not necessarily include the headered provision. Preferably, a service panel 127 is provided at the top of one side panel 122, and can also be provided for each of the side panels 122, 122' for access to the blower 150 and moisture recovery device 152. A bottom lip 128 is provided on the panels to direct cooling water sprayed on the coils inwardly and into the sump 124. Additionally, an internal slot **122*a*'** provides for protection and concealing of electrical wiring, sensors, or water piping.

Figure 35:
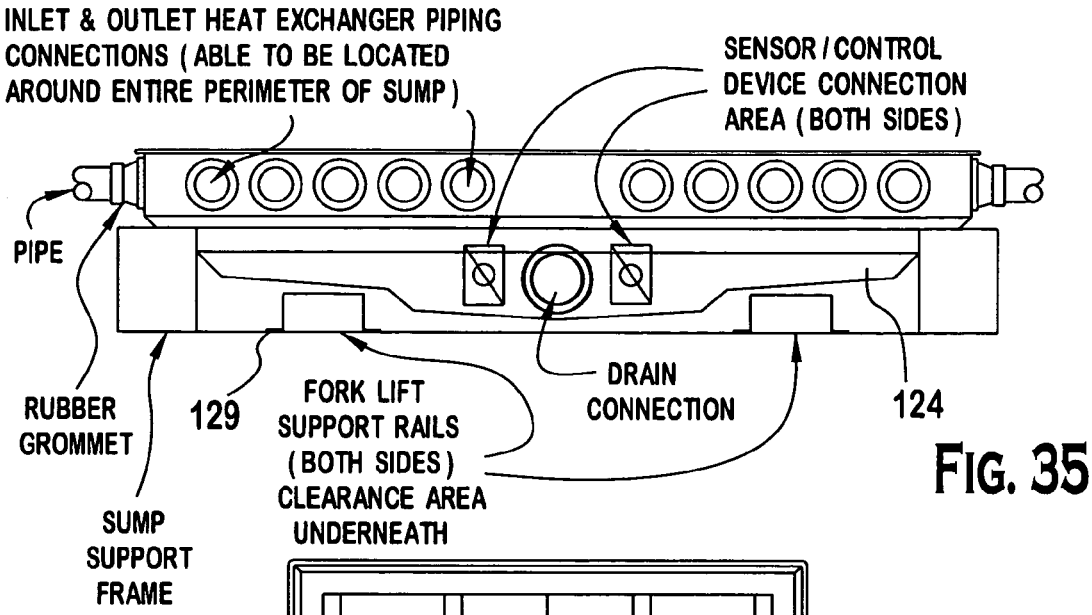
FIG. 35 is an enlarged view of the header end of the sump.
Figure 32:
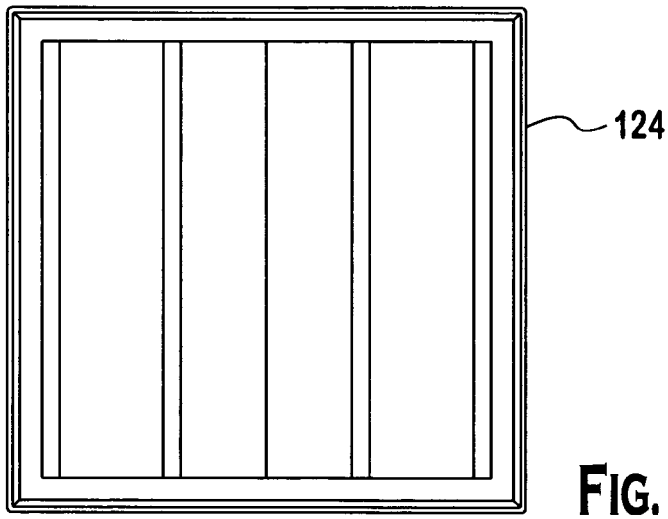
FIG. 32 is a plan view of the sump for the compact heat exchanger of FIG. 12.
Figure 33:
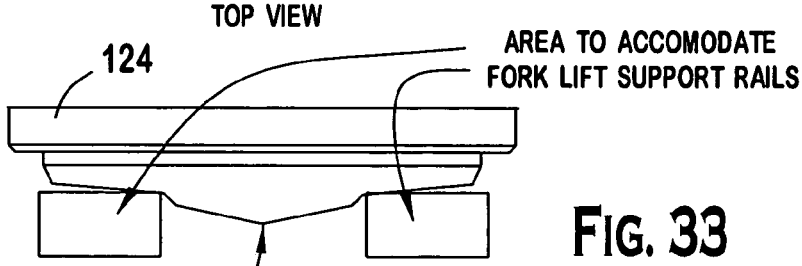
FIG. 33 is a front elevational view, with the positions of the fork lift supports and sensors indicated.
Figure 34:
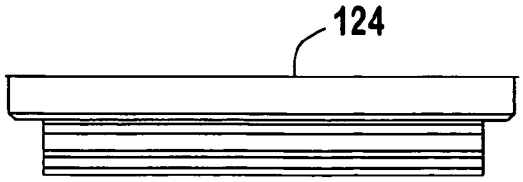
FIG. 34 is a right side elevational view of the sump of FIG. 32.
Figure 56:
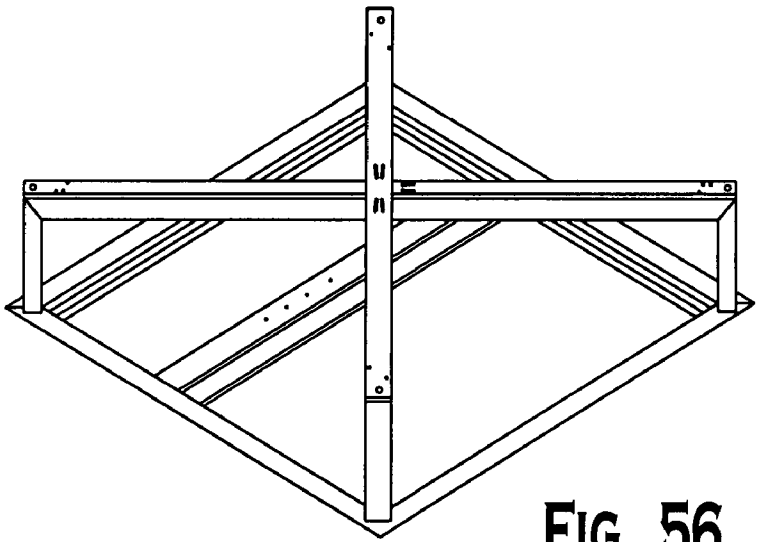
FIGS. 55 and 56 show the attachment of the liquid level switch to the coil support frame.
Figure 55:
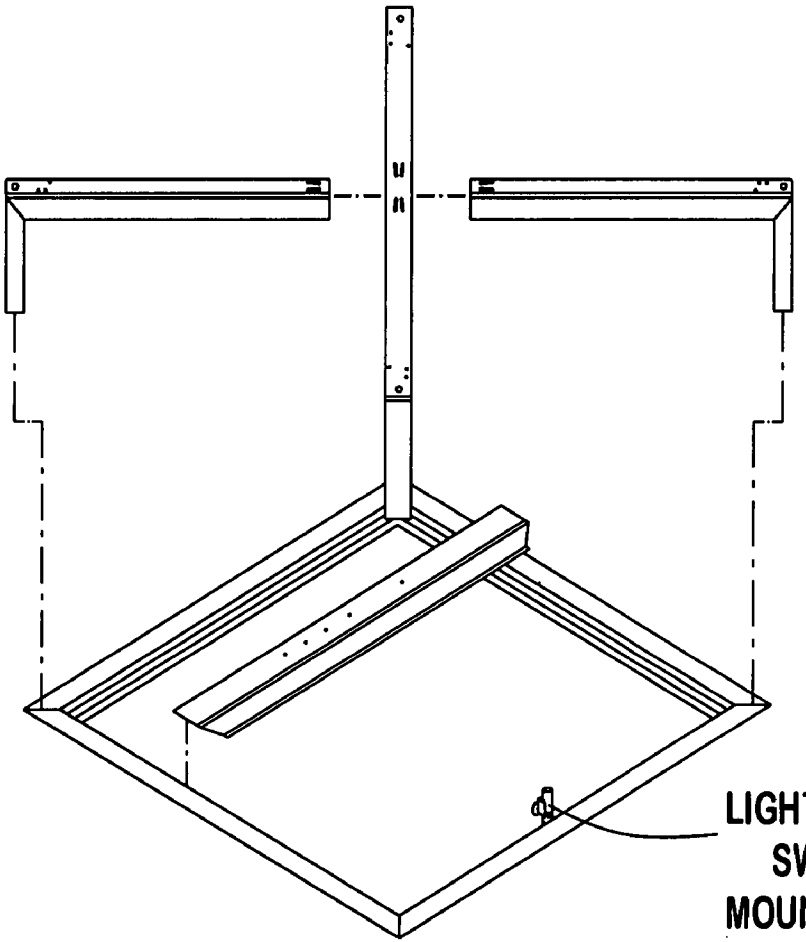
Figure 57:
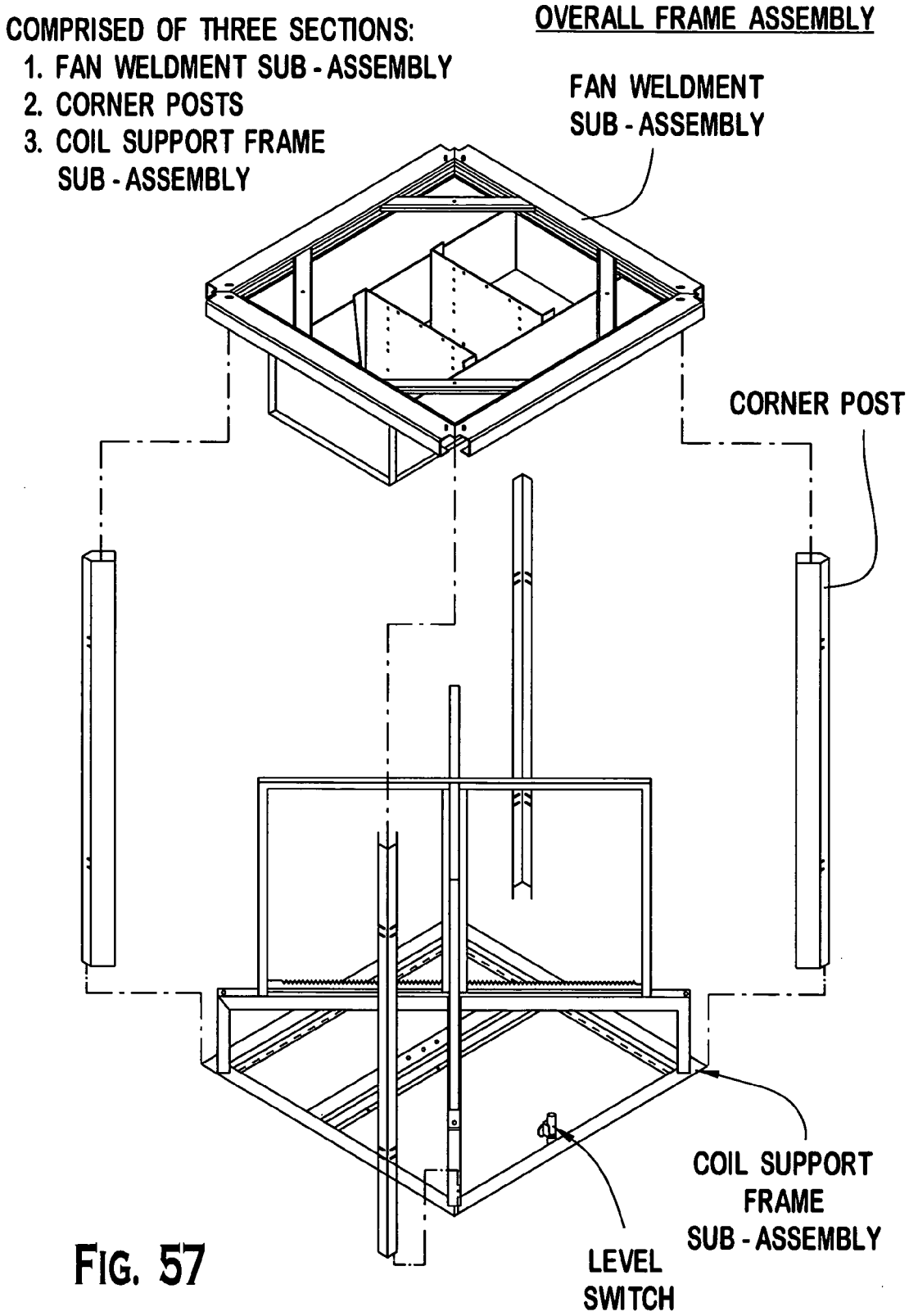
FIGS. 57 and 58 show a preferred frame assembly.
Figure 58:
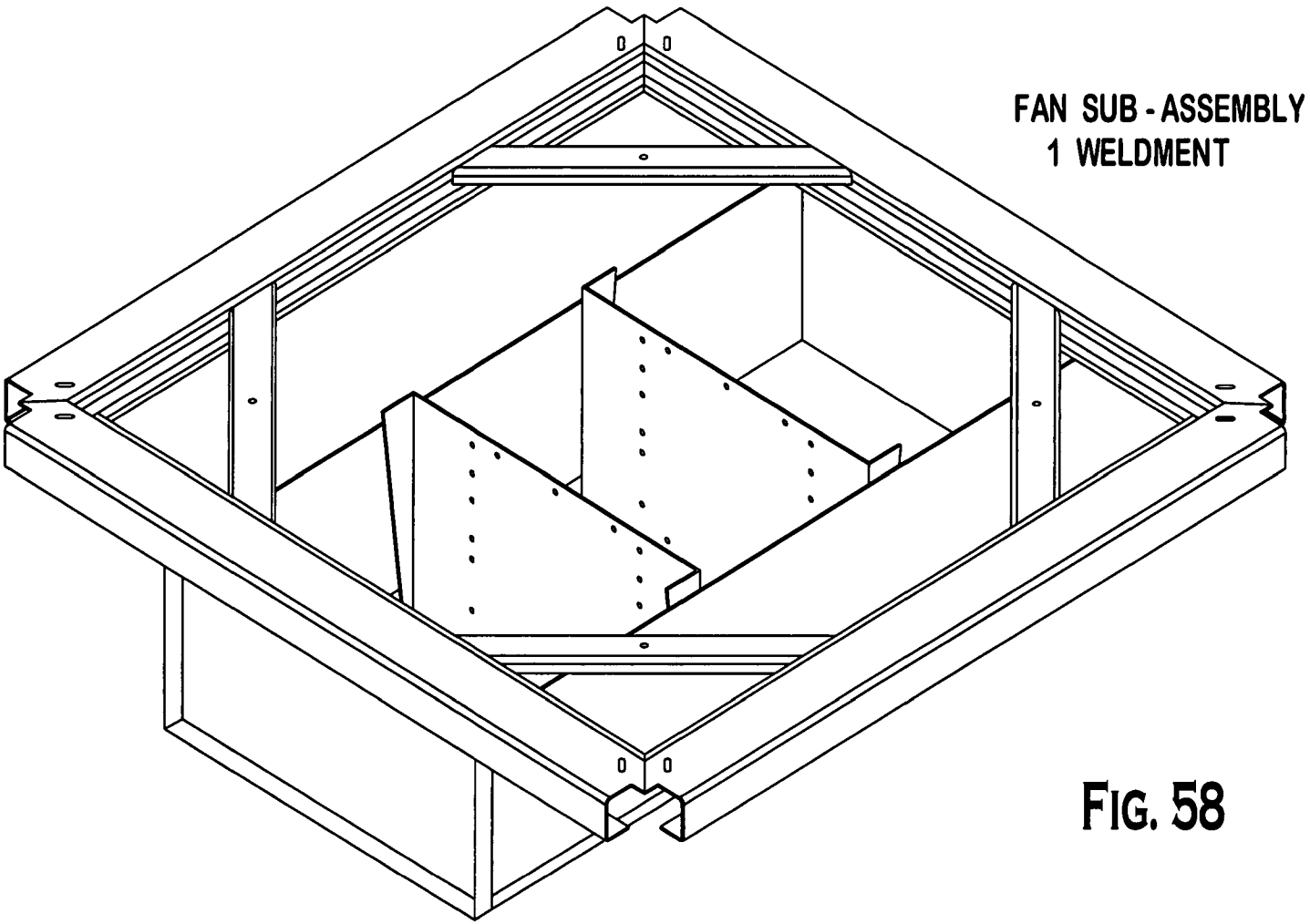
Figure 60:
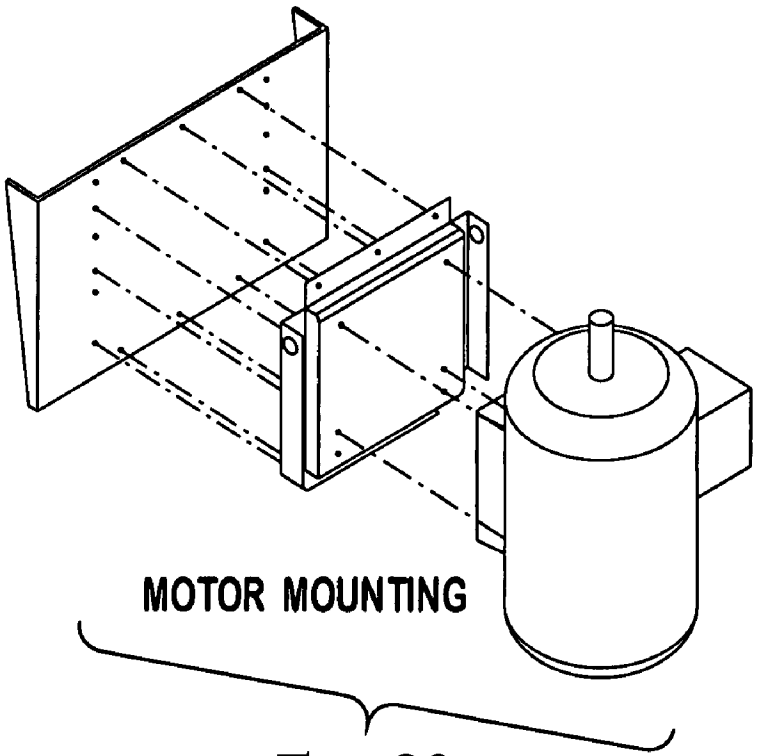
FIGS. 59 and 60 show a preferred motor mounting; the mounting plate that directly attaches to the motor is preferably attached first so that a crane or other lifting device can align the motor with the larger plate which is preferably supported on the heat exchanger frame; it is preferred that three bolts are aligned across the top and bottom of the smaller plate to assure the proper alignment with the larger plate and to secure the smaller plate thereto.
Figure 59:
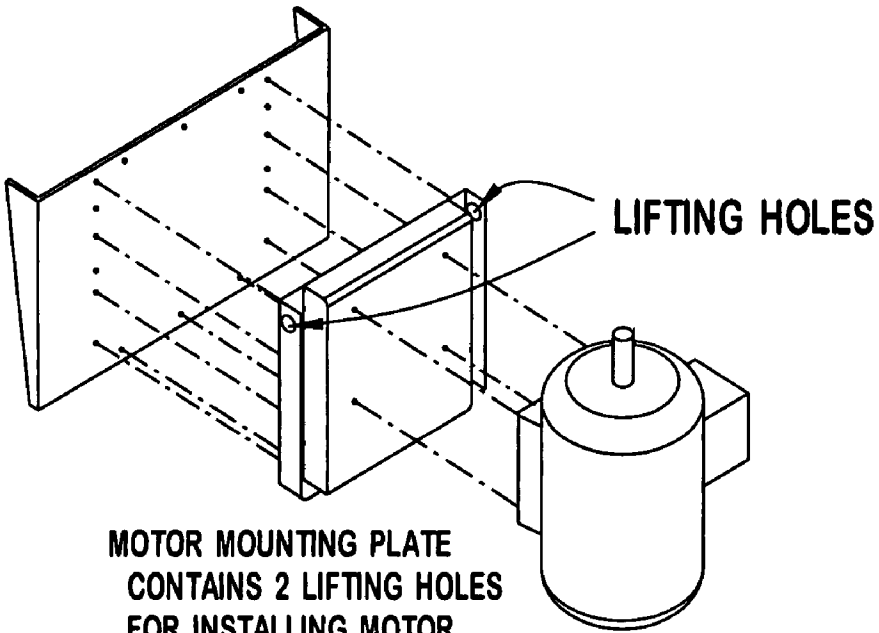
Figures 61, 62:
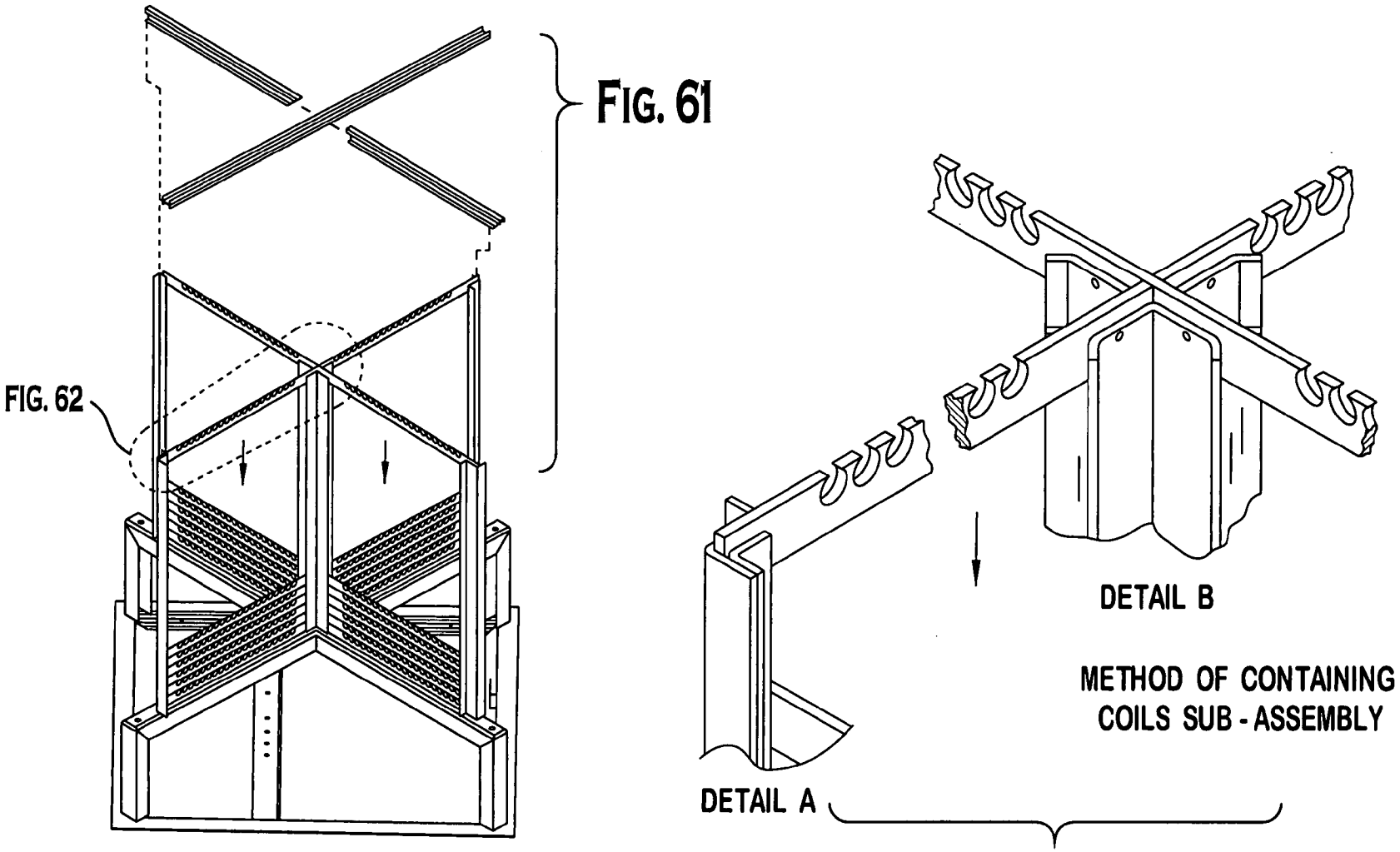
FIGS. 61 and 62 show an alternate way of stacking the spacers, and thus the coils, within the frame.

A preferred sump 124 is shown in detail in FIGS. 32-35. The sump 124 is preferably molded from a polymeric material, and is supported on a metal frame 129 (as shown in FIG. 35) which preferably includes fork lift support rails. Inlet and outlet connections can be located around the entire sump periphery, and are not limited to a single side. A drain connection is provided at a lower most point on the side, and the bottom of the sump is sloped toward the drain connection. A liquid level switch can be installed into the coil support frame in order to preclude damage as seen in FIGS. 55 and 56.

Rubber grommets are preferably used at all bulkhead connections and through piping to prevent leakage of water through the sump walls. Sensors, such as for liquid level, conductivity or other properties can also be located on the sump wall and preferably along the same elevation of the drain line to ensure accurate measurement. This is due to the fact that the liquid being measured is not subject to turbulence or agitation resulting from falling water droplets that are not evaporated but recollected in the sump.

Figure 41:
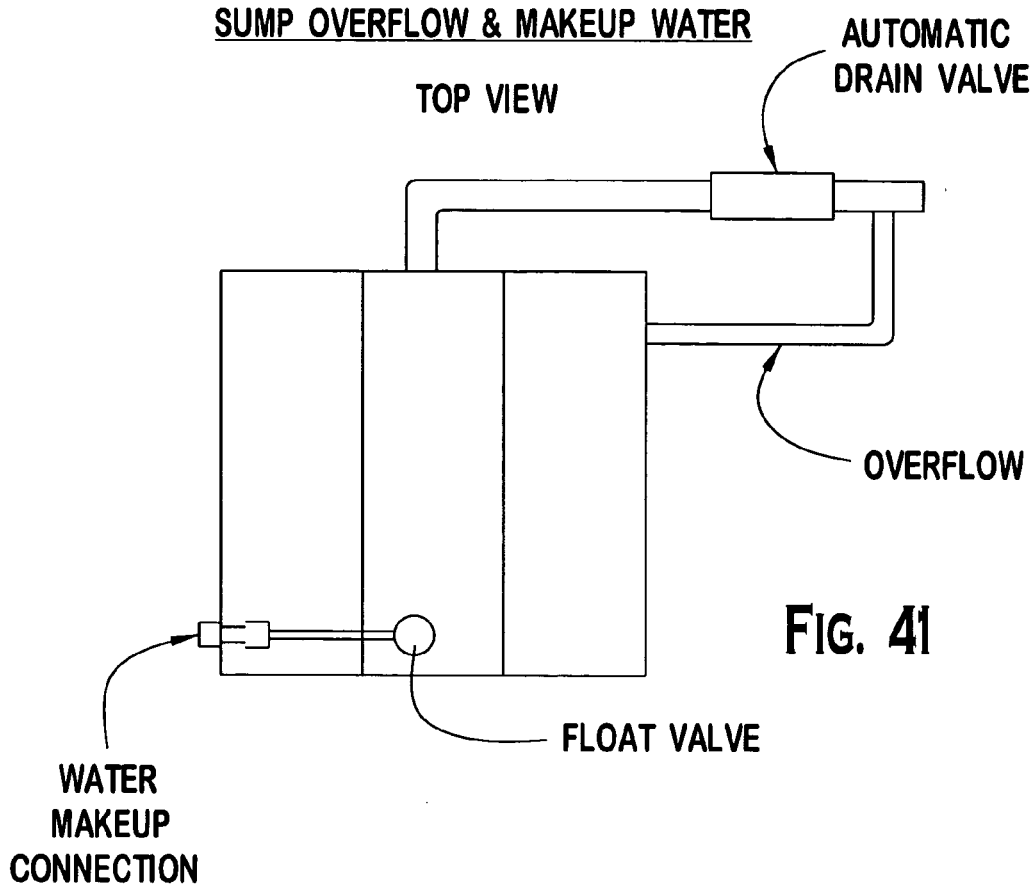
FIG. 41 is a top view of the sump illustrating a preferred water make-up connection and automatic drain.
Figure 42:
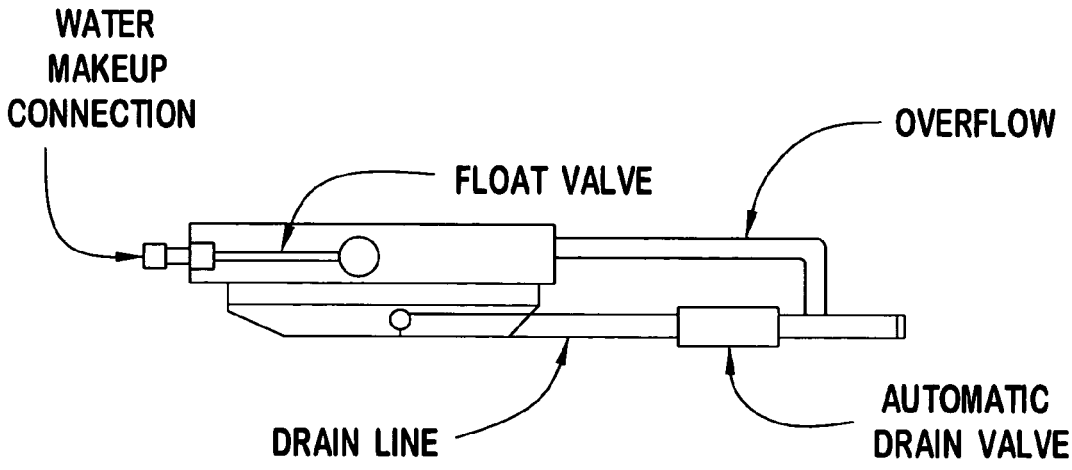
FIG. 42 is a side view of the sump arrangement shown in FIG. 4.
Figure 44:
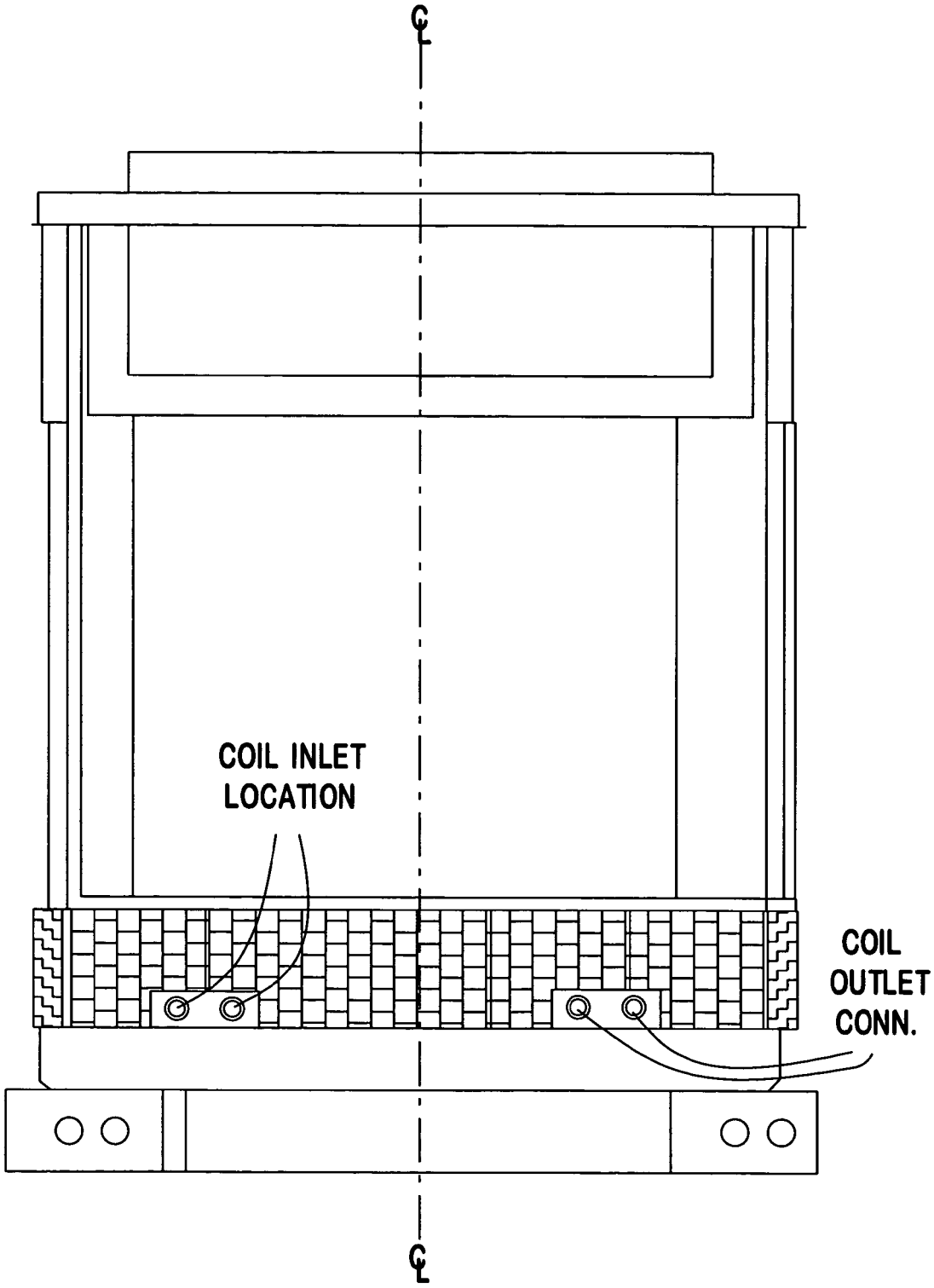
FIG. 44 is an alternate housing of the heat exchanger of the present invention illustrating the intake and outlet connections extending through the housing above the sump.
Figure 45:
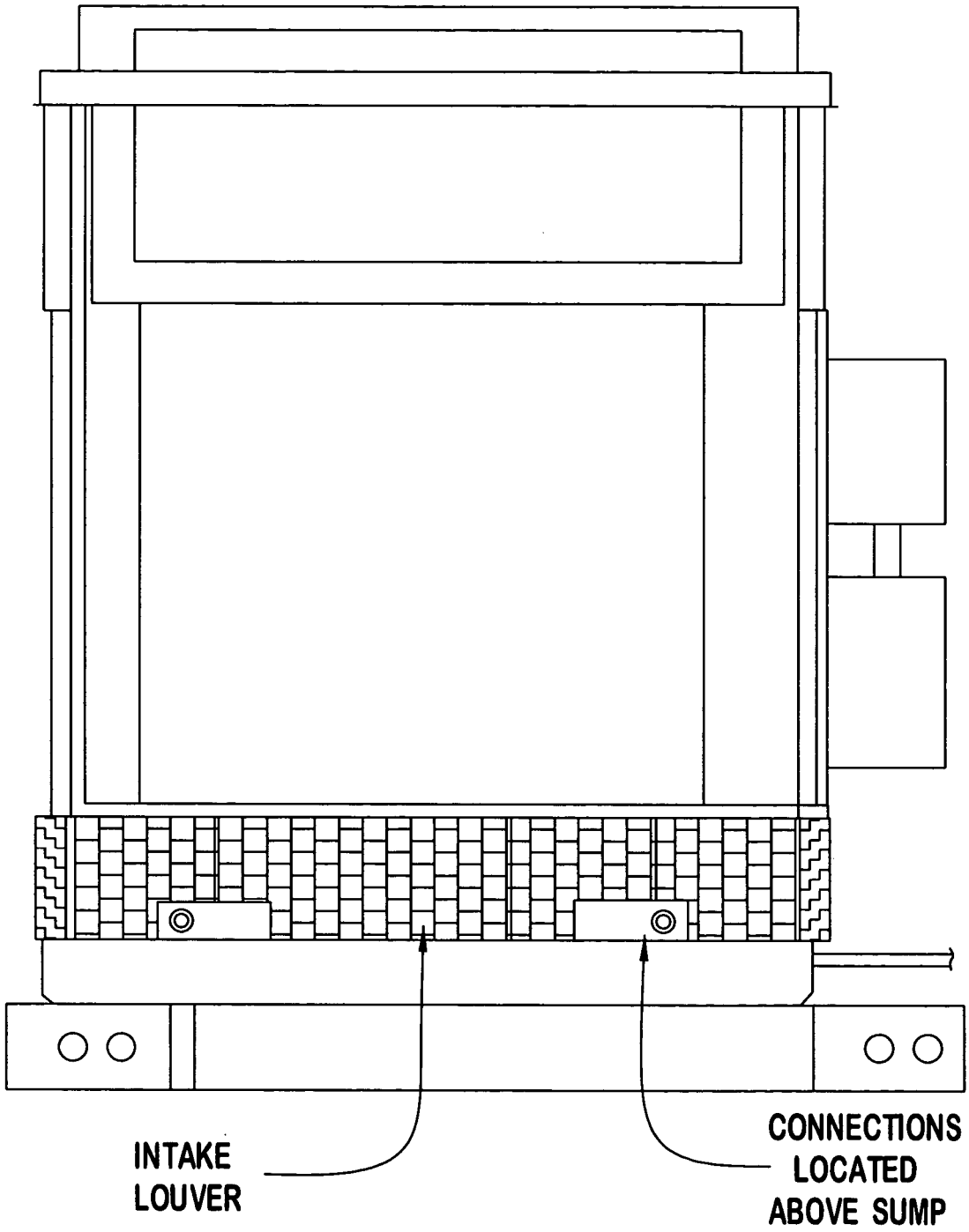
FIG. 45 illustrates the use of an intake louver in the heat exchanger of the present invention as opposed to the hood shown in FIG. 12; the intake louver is preferably one piece and allows for more compact construction; the intake louver is preferably corrugated to prevent water droplets from being ejected through the intake opening, this is advantageous in that it eliminates any baffling or moisture recovery device that may be used in conjunction with a hood.
Figure 46:
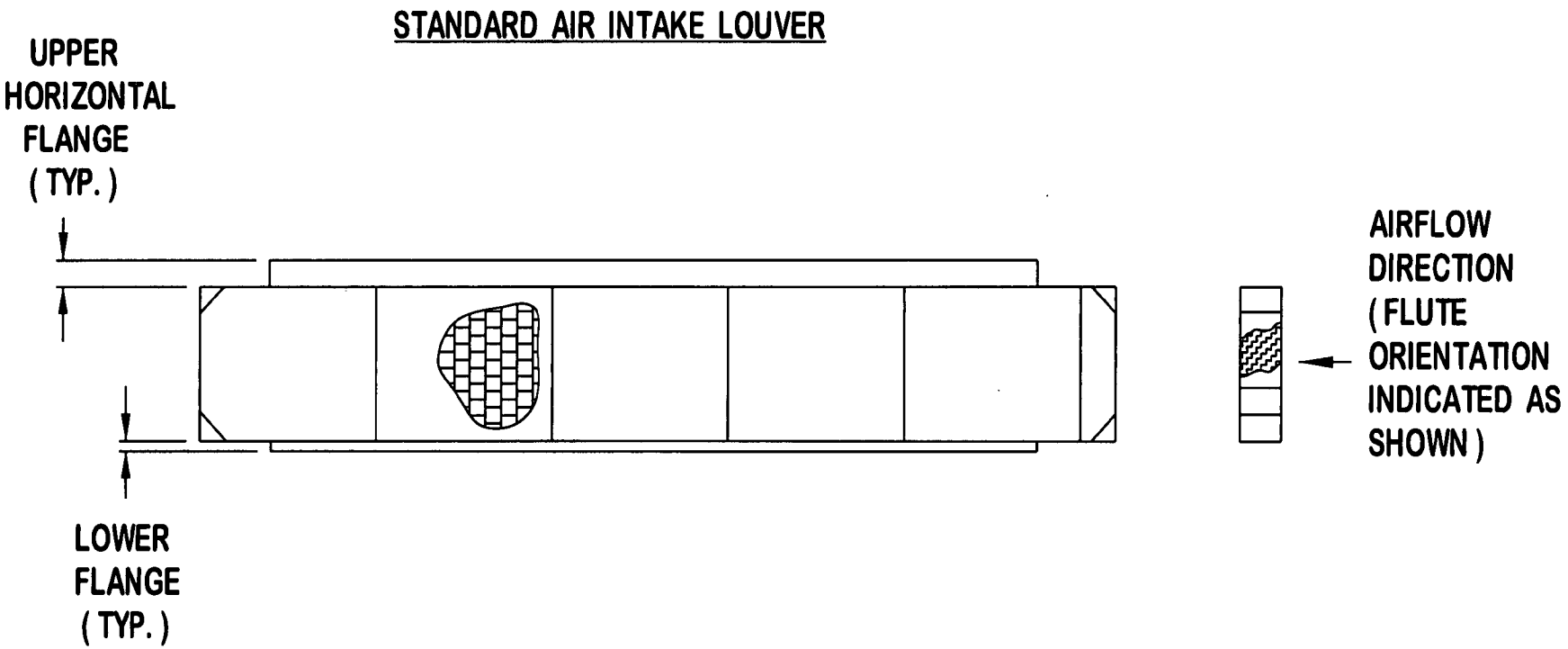
FIG. 46 illustrates the intake louver of FIG. 45 without connections extending therethrough.
Figure 47:
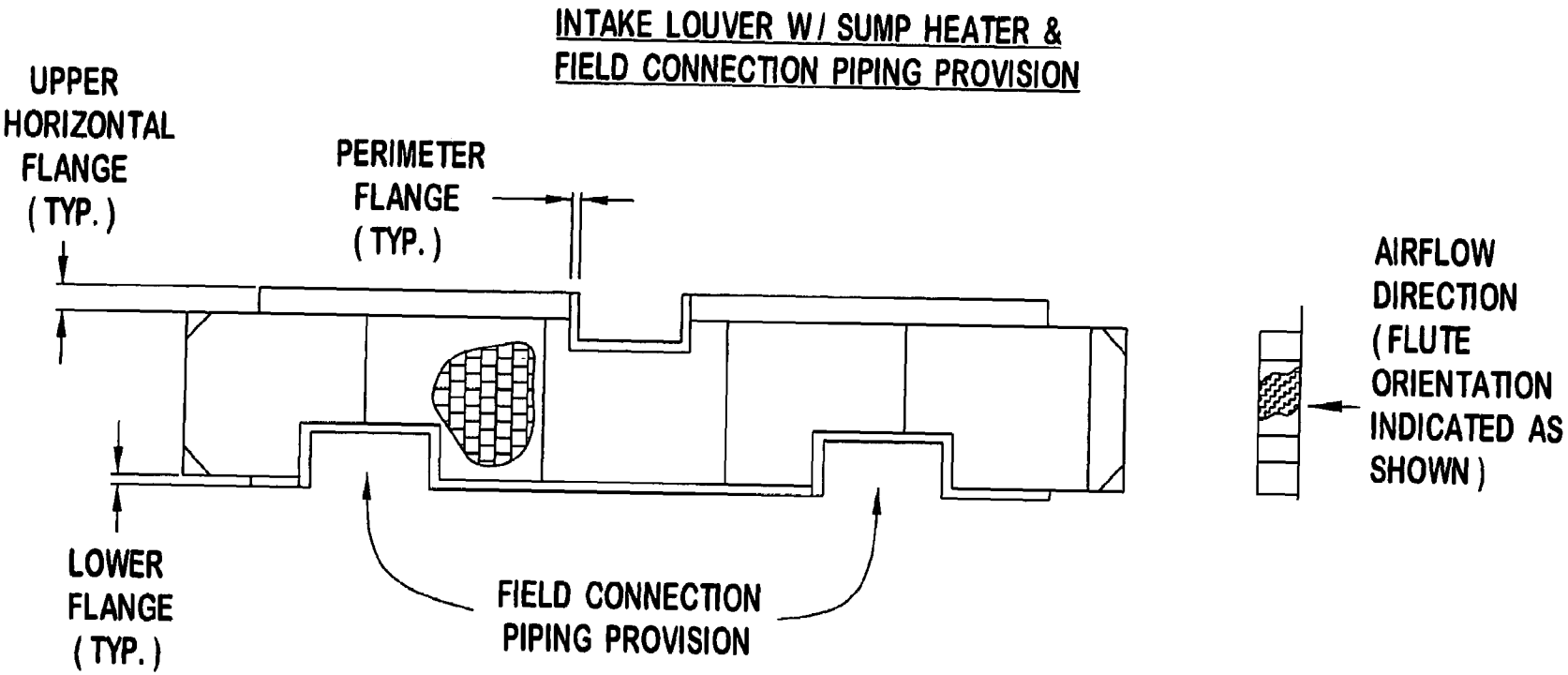
FIG. 47 illustrates the intake louver of FIG. 45 with holes for housing field connections.
Figure 48:
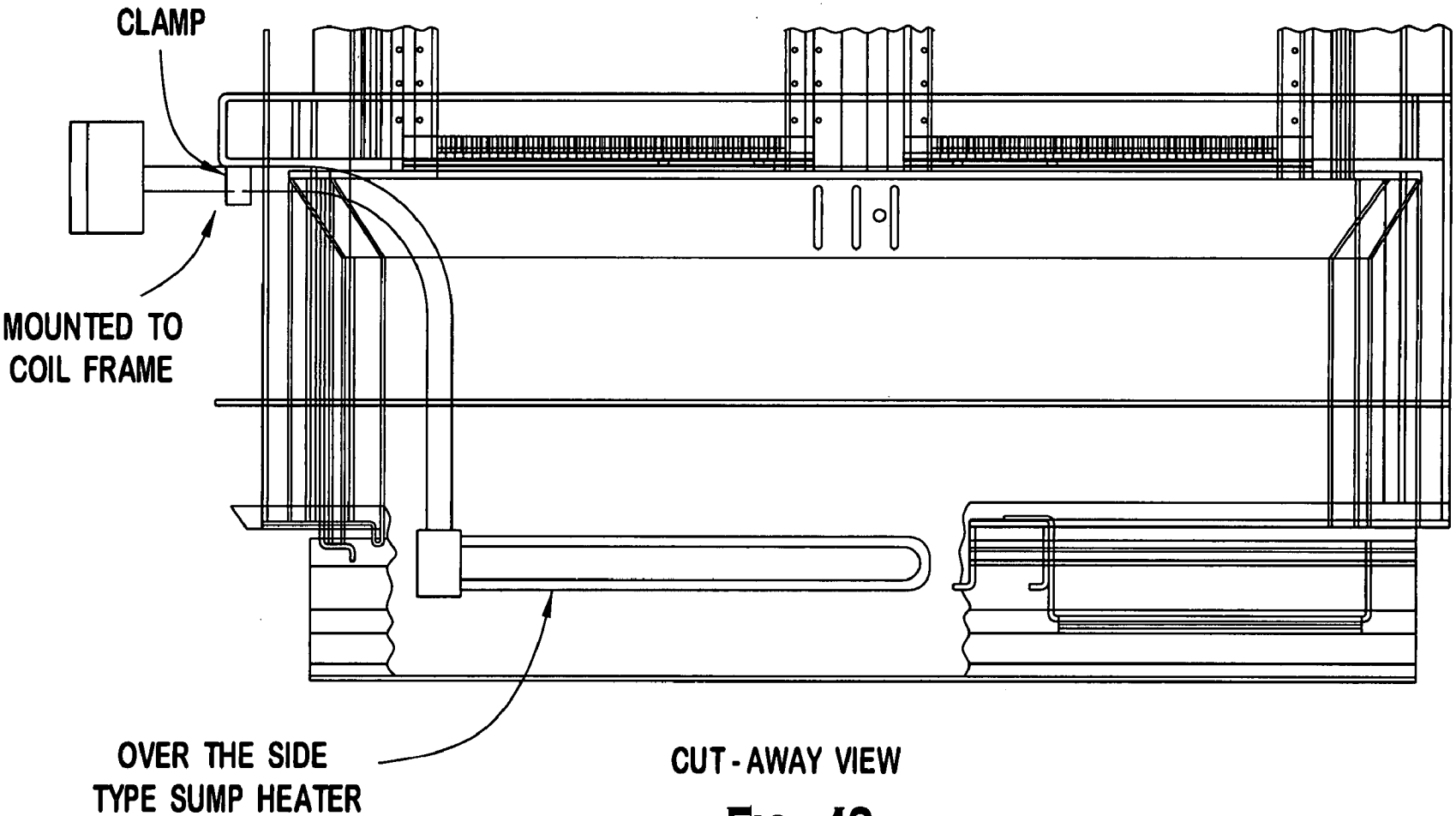
FIG. 48 illustrates the mounting of the louver to the coil frame.
Figure 50:
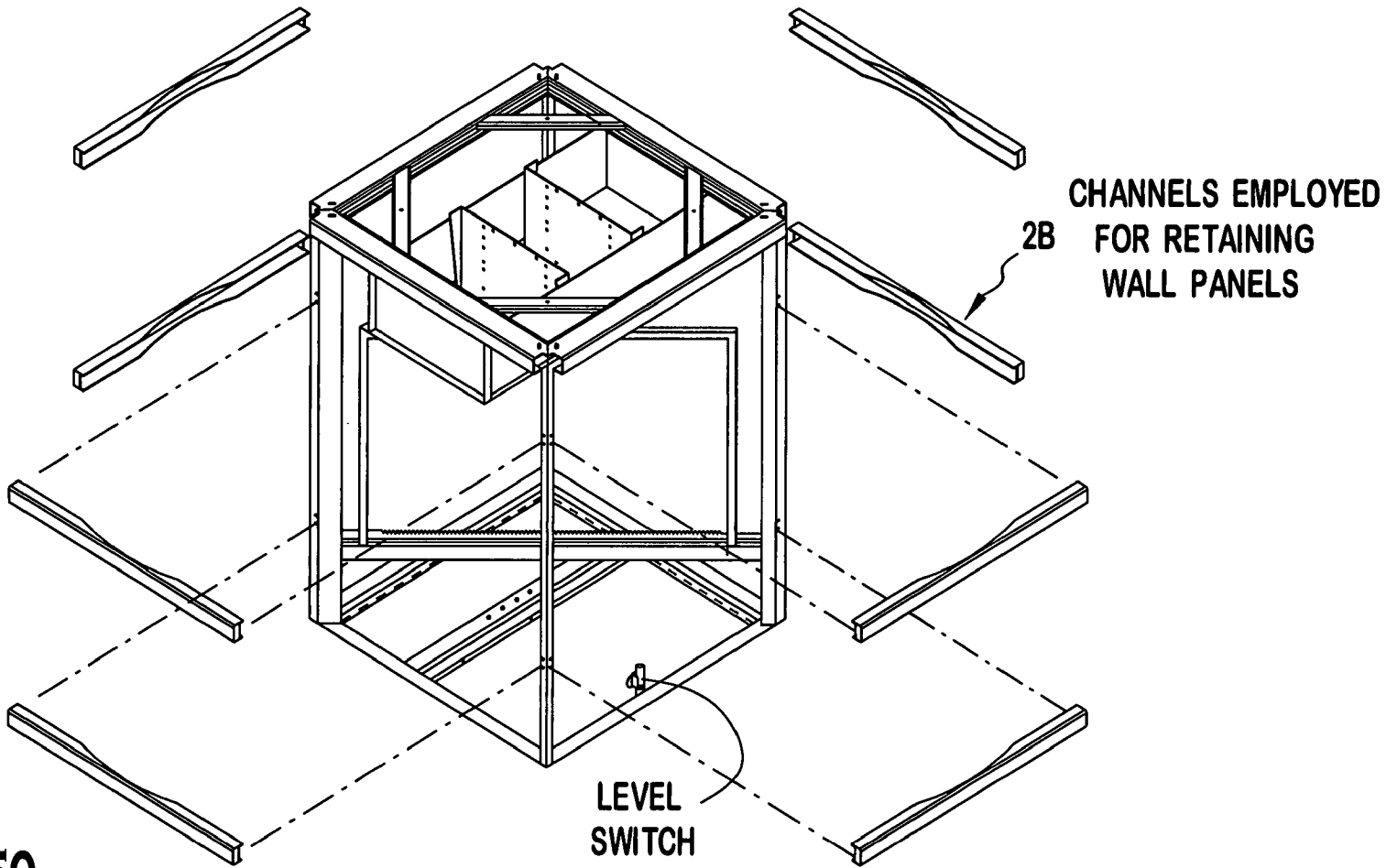
FIGS. 50-52 illustrate a preferred frame for the heat exchanger of the present invention.
Figure 51:
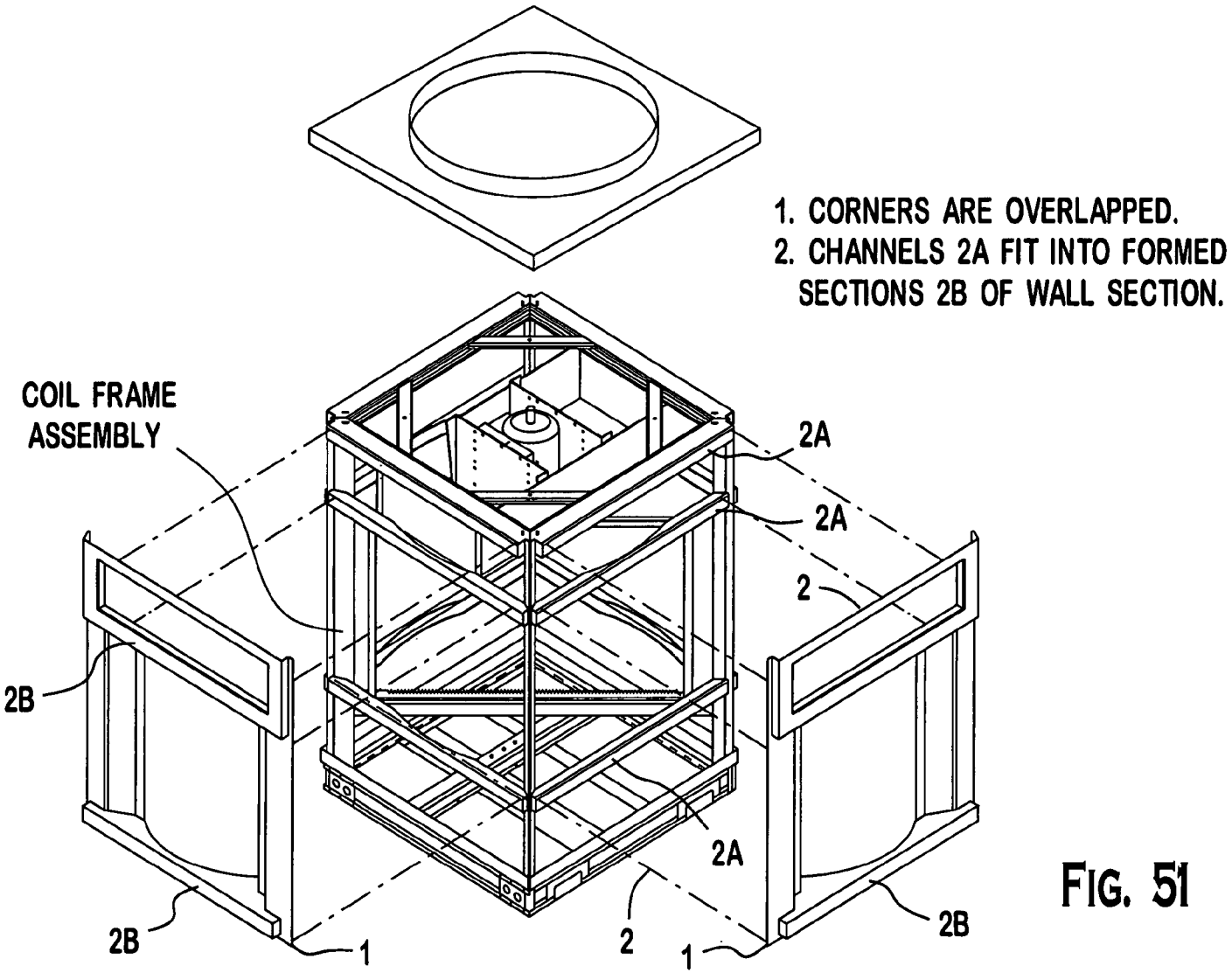
Figure 52:
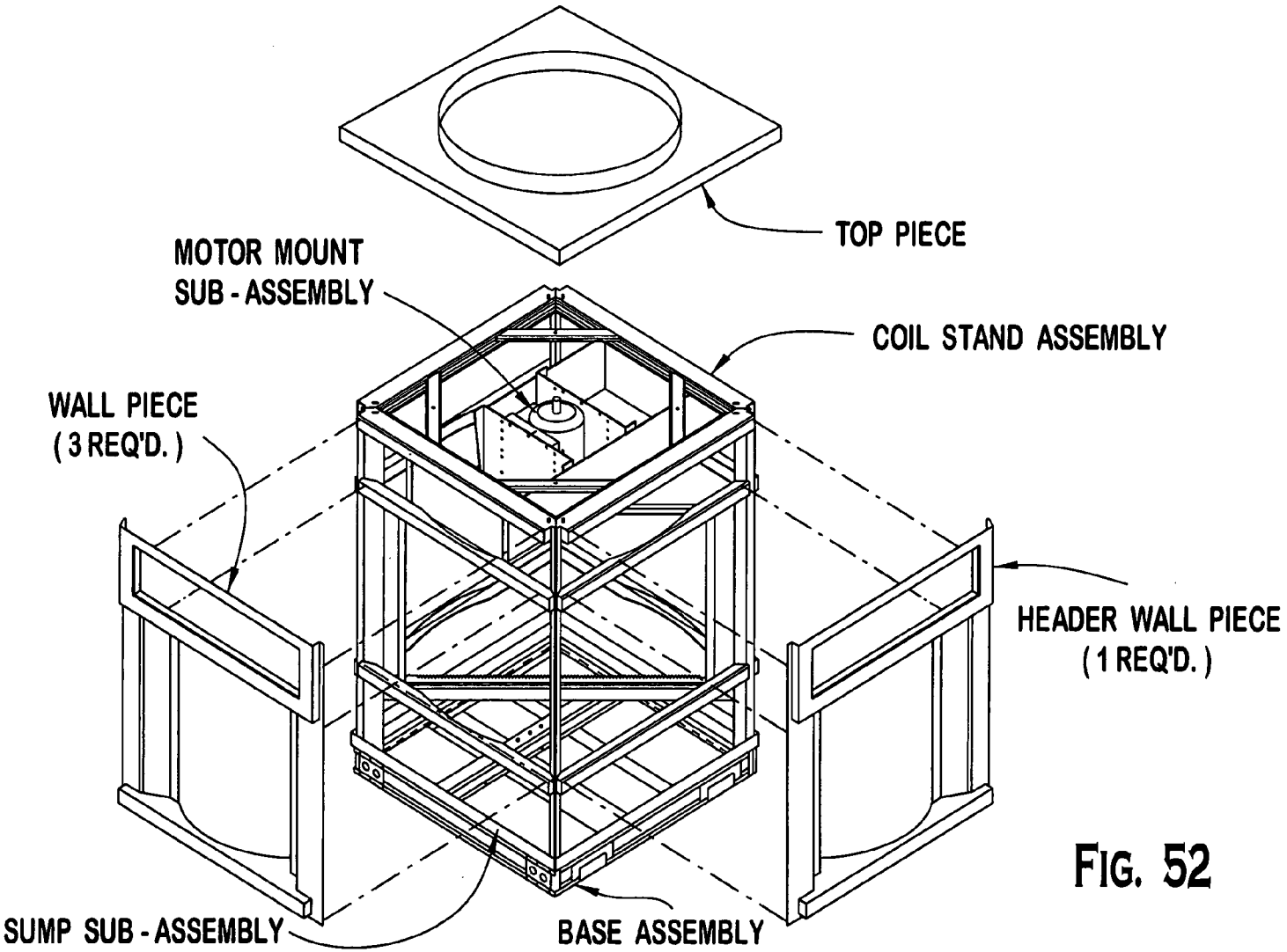
Figures 53, 54:
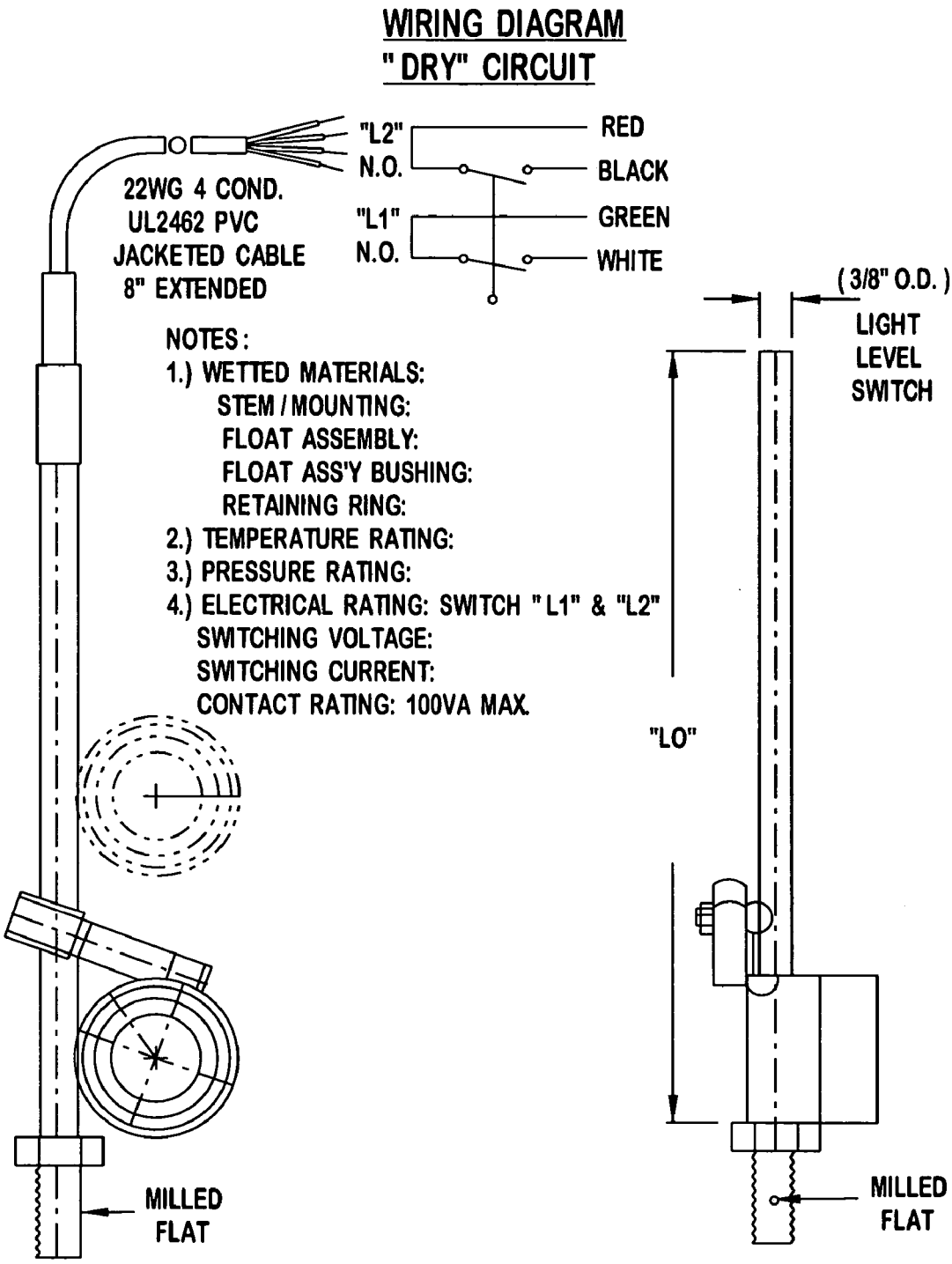
FIGS. 53 and 54 illustrate a liquid level switch that can be mounted on the coil supporting frame so that the switch does not add any weight to the housing which preferably remains non load bearing.

As shown in FIGS. 41 and 42, a water make-up arrangement is preferably provided, and can be located anywhere along the sump perimeter. Additionally, an overflow provision can also be provided. As shown in FIG. 44, the connections can also be made above the sump and through an intake louver (shown in FIG. 45) or another portion of the housing.

Figure 36:
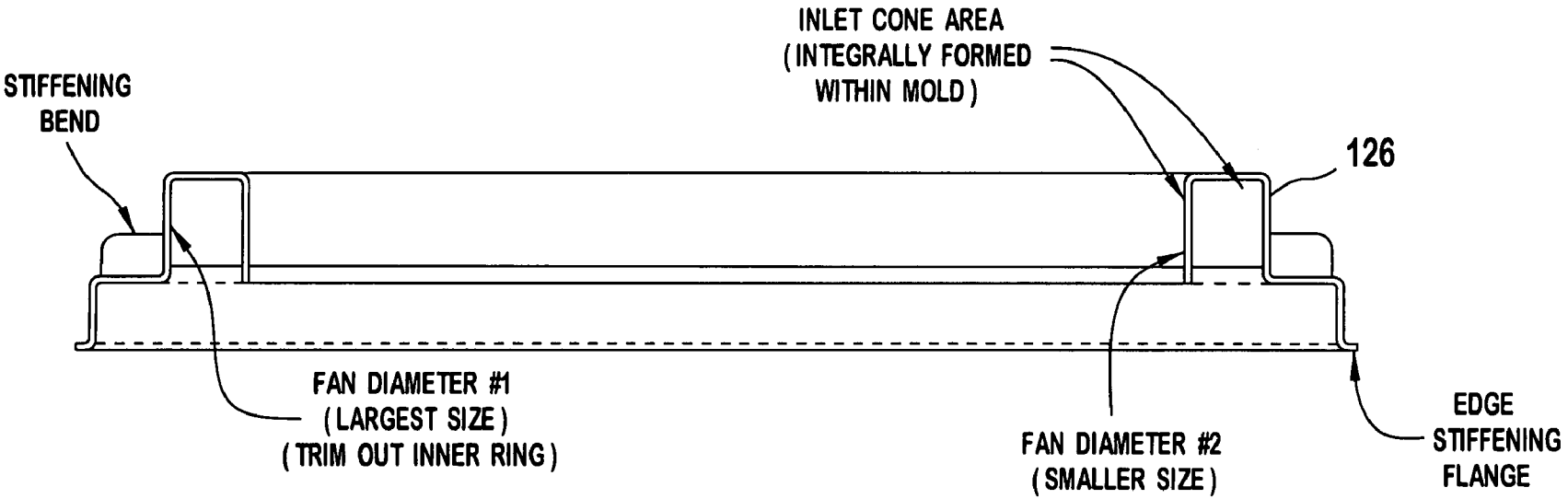
FIG. 36 is a cross-sectional view of the exhaust fan assembly for the compact heat exchanger of FIG. 12.

A top enclosure 126 with a blower 150 and a moisture recovery device 152 mounted thereto is supported by the posts 114. As shown in FIG. 36, the top enclosure 126 is preferably formed so that it accommodate fans of at least two different sizes by utilizing or trimming away the inlet cone area located radially around the fan for a draw through arrangement. The top enclosure can also be used with a blow through (forced air) arrangement by trimming a rectangular opening in the top which would be adapted to receive a moisture recovery device.

Figure 13:
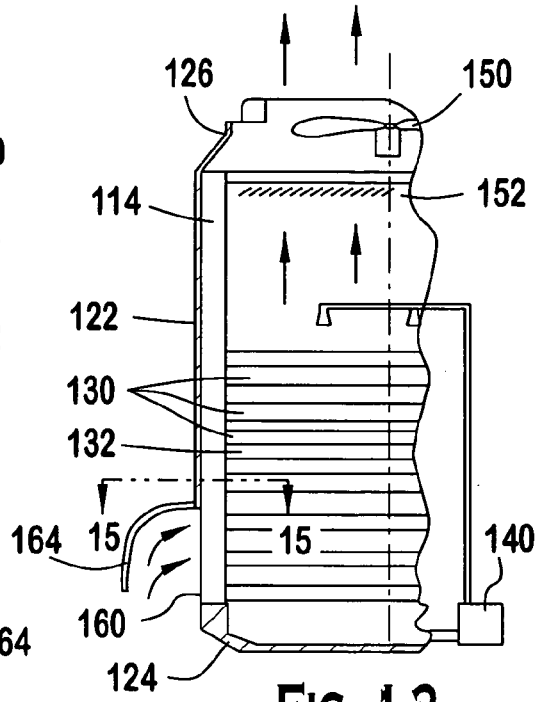
FIG. 13 is a cross-sectional view, which is partially broken away and shown in schematic form, of the compact heat exchanger of FIG. 12.
Figure 14:
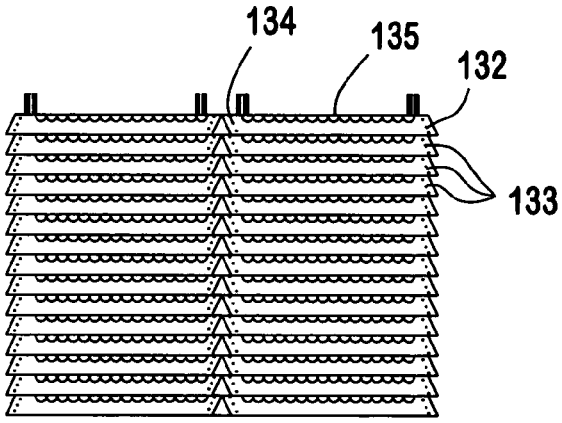
FIG. 14 is an elevational view of the heat exchanger coils used in the compact heat exchanger of FIG. 12.
Figure 15:
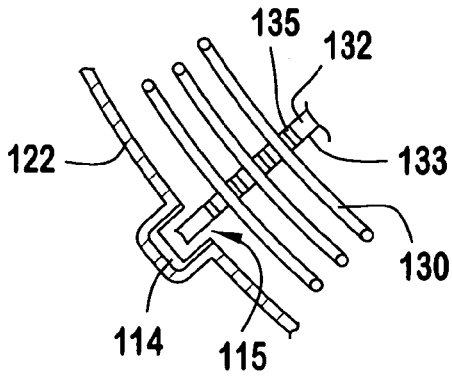
FIG. 15 is a view taken along lines 15-15 in FIG. 13 to show the ends of the tube supports in the frame post channels and the tube spacers.
Figure 16:
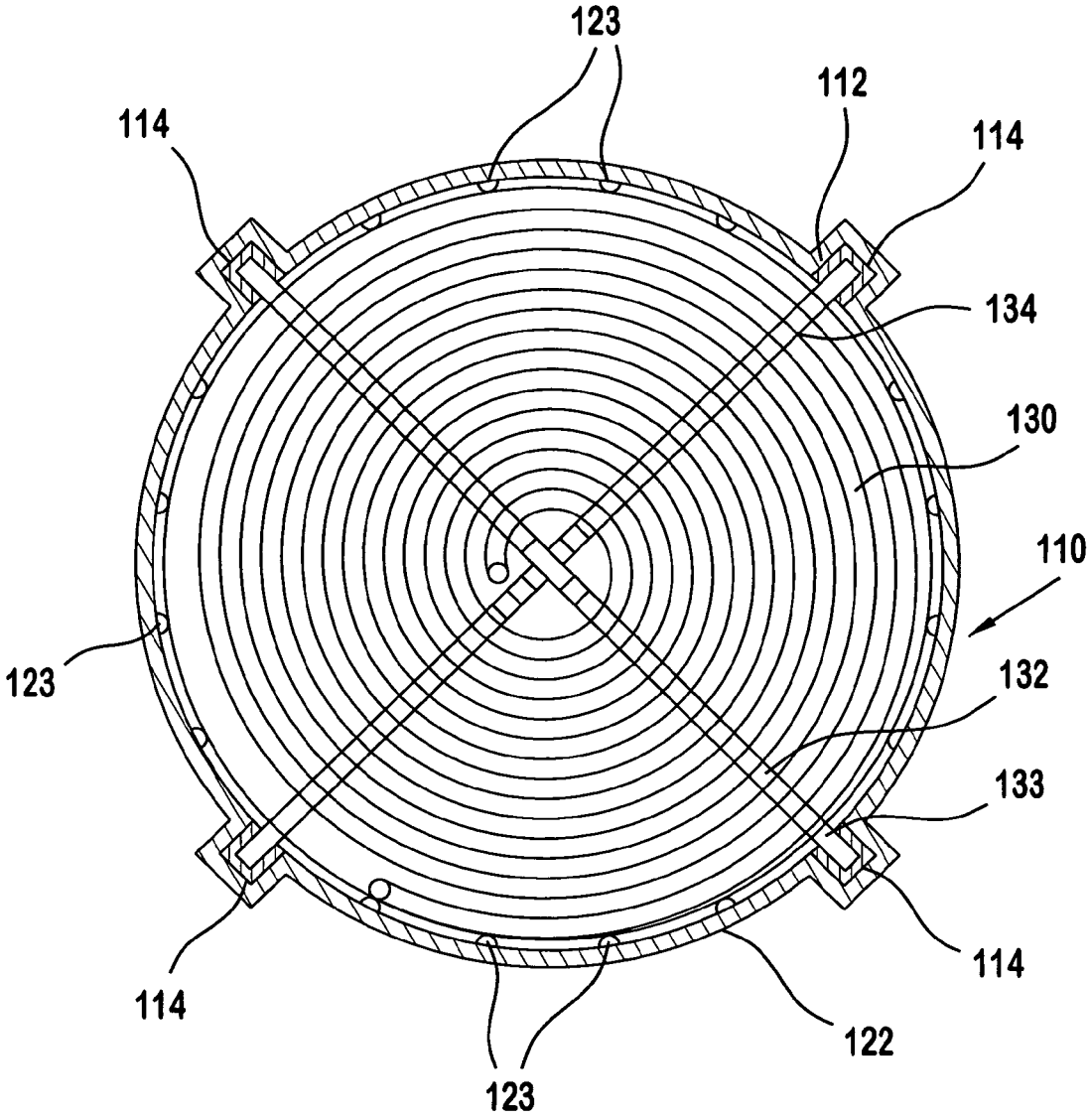
FIG. 16 is a cross-sectional view taken along lines 16-16 in FIG. 12.

As shown in FIG. 13, a pump 140 is used to pump cooling water used for evaporative cooling of the coils 130 to spray nozzles 142 via distribution tubes 144, in a similar manner to the first embodiment, as described above. Preferably, the pump 140 is located in the sump 124.

Figure 39:
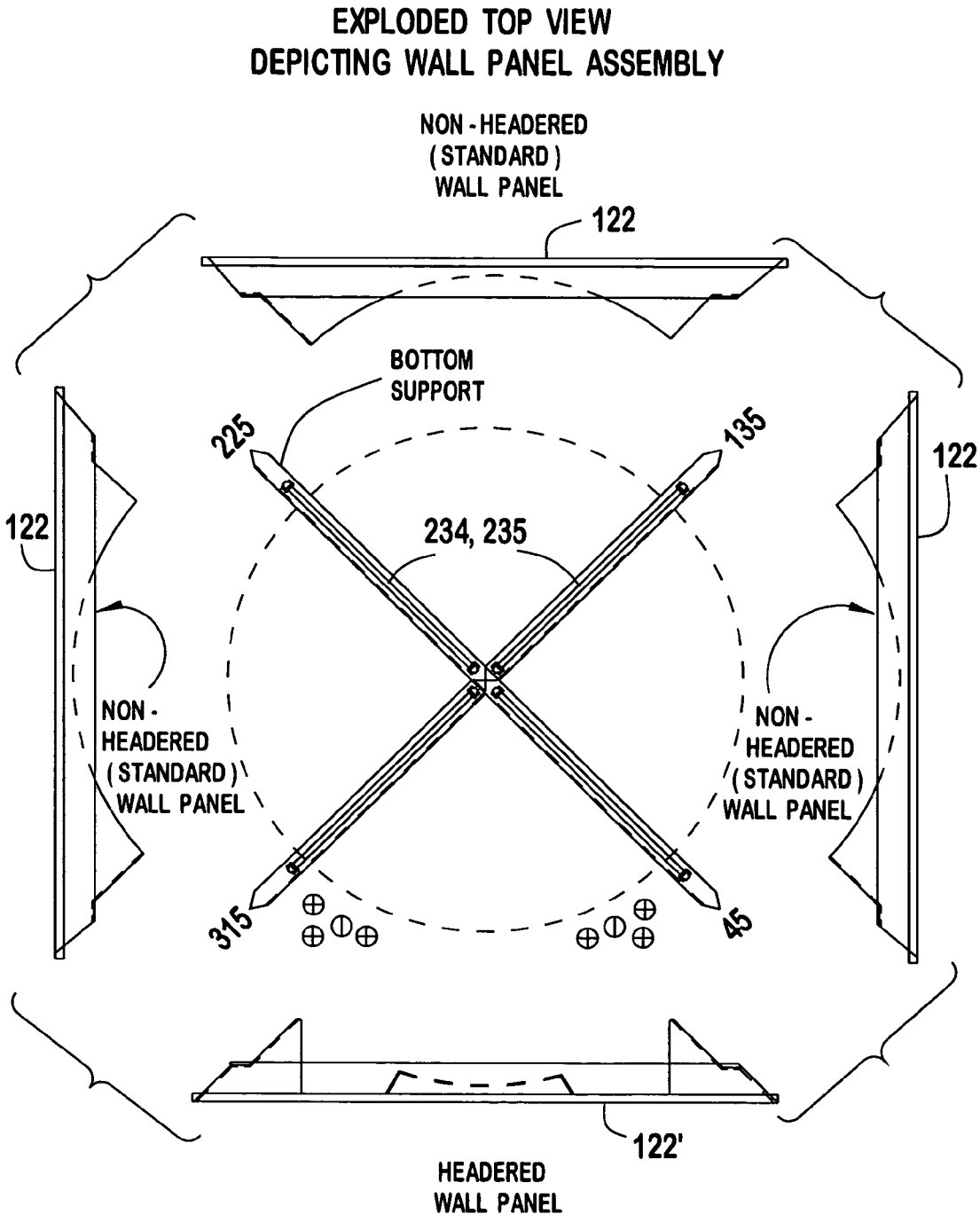
FIG. 39 is a top view of the four sidewalls and the bottom heat exchanger tube support shown in a disassembled state.
Figure 40:
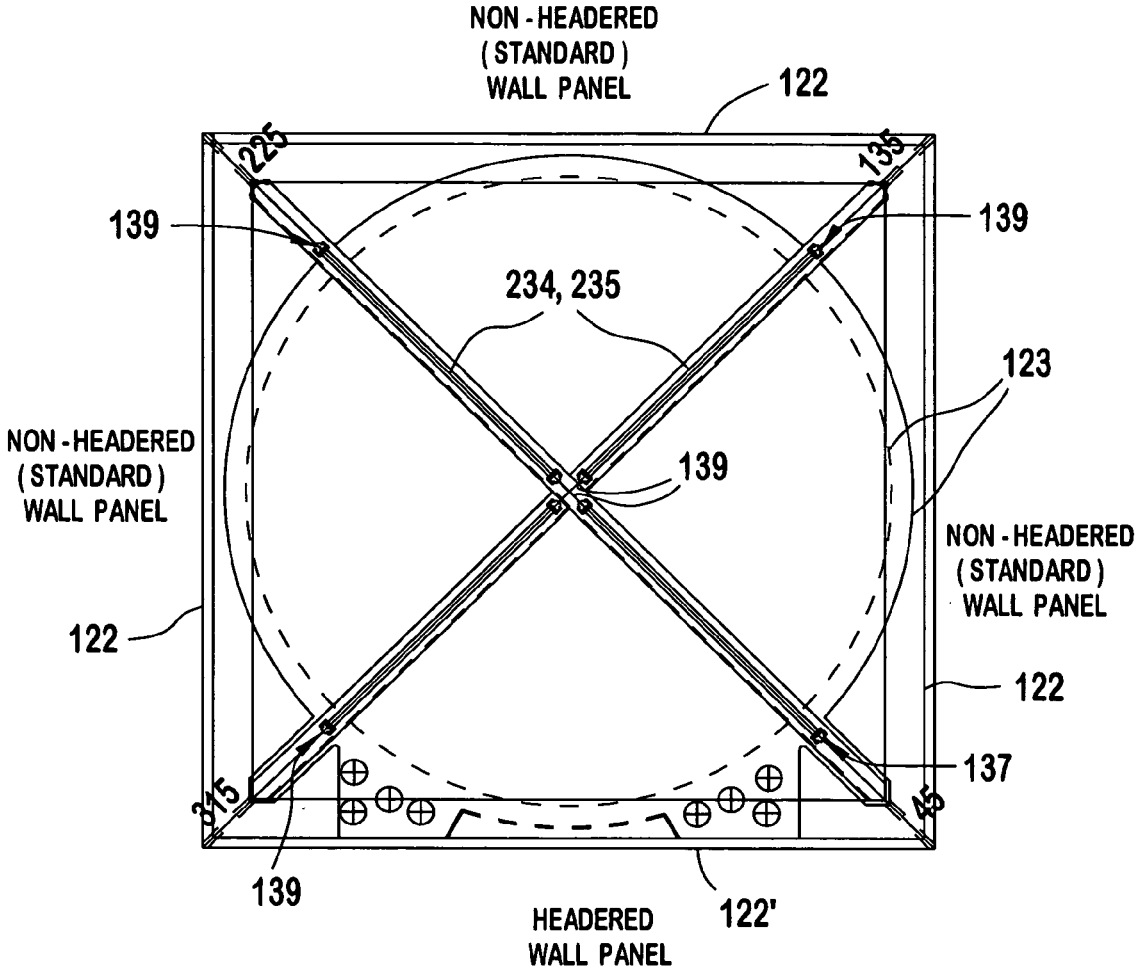
FIG. 40 is a top view similar to FIG. 39 showing the four sidewalls and the bottom heat exchanger frame assembled.

FIGS. 39 and 40 show the sidewalls 122, 122' being assembled, with the bottom coil support as well as the stackable tube supports 234, 235 shown in position. I or T-shaped posts are used to stack the flat coils 130 (not shown) installed in the tube supports 234, 235.

The use of the flat coils 130 allows for more cooling coil surface area to be contained within a given volumetric space. This allows for more cooling capacity within a limited footprint. Additionally, by using cooling coils 130 located on support bars 133, 134 that can be stacked and held in position by channels 116 in the posts 114, or by separate vertical posts installed through channels 237 of the assembled supports 234, 235, assembly time is reduced, and heat exchangers having various cooling capacities can be readily assembled or reconfigured using the same components.

To provide additional efficiency to the heat exchanger 110, the cooling coils 130 in a given heat exchanger can be connected in series or in parallel, or a combination of both with valves for opening and closing circuits to provide different cooling capacities. Additionally, two or more separate cooling circuits can be wound in the same flat coil 130, and different cooling circuits can be activated using valves (not shown), depending on the cooling load.

To improve the cooling airflow, airflow openings 160 are preferably provided between the entire bottoms of the sidewall panels 122 and the top of the sump 124. Intake vent covers 164 similar to those described above in connection with the first embodiment can be located over the openings 160 to prevent the ingress of debris and preclude the penetration of sunlight into the sump.

Two different types of flat coils 130 may be provided having different tube spacing and/or diameters, so that the tubes are staggered relative to tubes of the vertically adjacent coils 130. This provides better heat exchanger efficiency.

Figure 37:
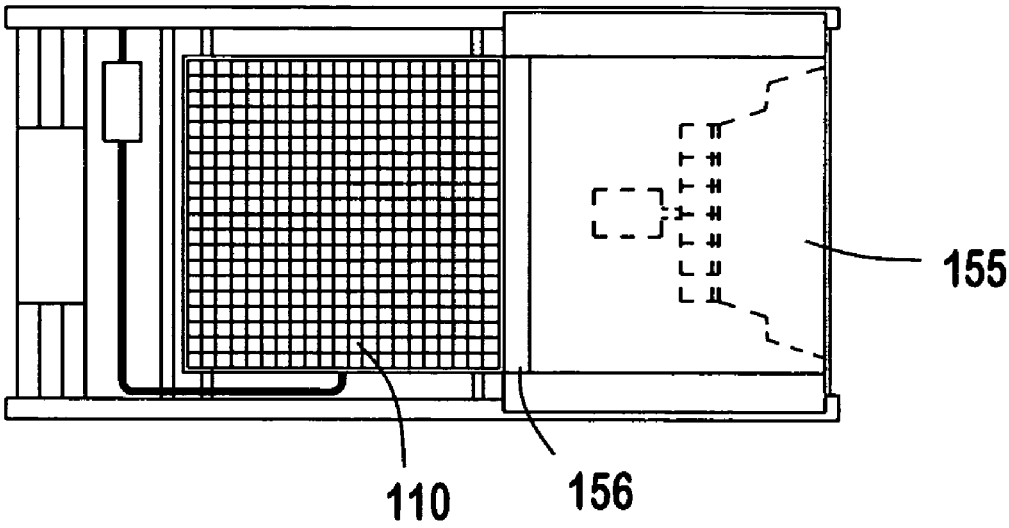
FIG. 37 is a top plan view of a blow-through heat exchanger arrangement.
Figure 38:
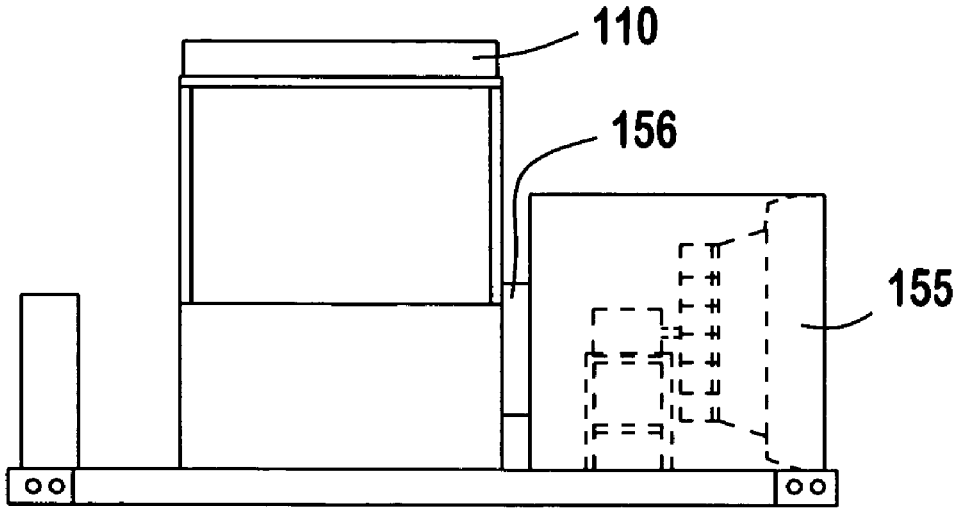
FIG. 38 is a side elevational view of the blow through heat exchanger arrangement of FIG. 37.

Referring now to FIGS. 37 and 38, a blow through fan 155 is shown in connection with the compact heat exchanger 110. The fan 155 is mounted on the side of the heat exchanger 110 so that additional heating coils 130 can be stacked within a given housing height because no fan is provided on top. A duct 156 connects the fan outlet to the bottom of the heat exchanger 110 on at least one side. Any remaining openings on the bottom of the heat exchanger 110 are closed off with panels formed from plastic or any other suitable material. This arrangement allows for more cooling capacity within a height limited area by allowing more coils 130 to be stacked in the housing. This is advantageous in many applications.

It will be recognized by those skilled in the art from the above description, that changes may be made to the above described embodiments of the invention without departing from the broad inventive concept thereof. As such, any of the features shown in either of the preferred embodiments can be used with either embodiment or in combination. It is understood, therefore, that this invention is not limited to the particular embodiments disclosed, but that it is intended to cover all modifications which are within the spirit and scope of the invention as defined by the appended claims and/or as shown in the attached drawings.

What is claimed is:

1. A heat exchanger comprising:

a housing having a base and defining an interior;

a plurality of coils located in the interior of the housing and arranged to extend upwardly from the base to define a coil depth;

a blower adapted to move air through the plurality of coils in a direction of the coil depth;

a water distribution system to spray water onto the plurality of coils, wherein the water distribution system is located around a circumferential periphery of the plurality of coils to spray water on an outer surface of the plurality of coils along the entire coil depth thereof;

at least one air inlet opening located in the housing to allow airflow across the plurality of coils;

a coil alignment mechanism located on the base for positioning the plurality of coils thereon, the number of the plurality of coils being adjustable so that a desired amount of cooling is provided by the heat exchanger; and the coil alignment mechanism comprises a plurality of posts which extend generally upwardly from the base, and each of the plurality of coils is connected to the plurality of posts using a sliding engagement.

2. The heat exchanger of claim 1, wherein the plurality of coils comprise stacked spiral coils.

3. The heat exchanger of claim 1, wherein the number of the plurality of coils can be adjusted retroactively after the heat exchanger has been assembled without changing a size of the housing.

4. The heat exchanger of claim 3, wherein the number of plurality of coils is increased due to the addition of coils forming an additional cooling circuit.

5. The heat exchanger of claim 2, wherein the plurality of coils comprises at least two cooling circuits.

6. The heat exchanger of claim 1, wherein the base comprises fork lift support rails.

7. A heat exchanger comprising:

a housing having a base and defining an interior;

a plurality of coils located in the interior of the housing and arranged to extend upwardly from the base to define a coil depth;

a blower adapted to move air through the plurality of coils in a direction of the coil depth;

a water distribution system to spray water onto the plurality of coils, wherein the water distribution system is located around a circumferential neither of the plurality of coils to spray water on an outer surface of the plurality of coils along the entire coil depth thereof;

at least one air inlet opening located in the housing to allow airflow across the plurality of coils;

a coil alignment mechanism located on the base for positioning the plurality of coils thereon, the number of the plurality of coils being adjustable so that a desired amount of cooling is provided by the heat exchanger; and the plurality of coils include at least one coil having a different diameter and/or a different spacing between vertically adjacent coils than the remaining coils.

8. A heat exchanger comprising:

a housing having a base and defining an interior;

a plurality of coils located in the interior of the housing and arranged to extend upwardly from the base to define a coil depth;

a blower adapted to move air through the plurality of coils in a direction of the coil depth;

a water distribution system to spray water onto the plurality of coils, wherein the water distribution system is located around a circumferential periphery of the plurality of coils to spray water on an outer surface of the plurality of coils along the entire coil depth thereof;

at least one air inlet opening located in the housing to allow airflow across the plurality of coils;

a coil alignment mechanism located on the base for positioning the plurality of coils thereon, the number of the plurality of coils being adjustable so that a desired amount of cooling is provided by the heat exchanger; and the housing comprises inner and outer sidewalls that define a passage therebetween.

9. The heat exchanger of claim 1, wherein the housing includes a moisture recovery device which generally prevents water from being blown out of the housing.

10. A heat exchanger comprising:

a housing having a base and defining an interior;

a plurality of coils located in the interior of the housing and arranged to extend upwardly from the base to define a coil depth;

a blower adapted to move air through the plurality of coils in a direction of the coil depth;

a water distribution system to spray water onto the plurality of coils, wherein the water distribution system is located around a circumferential periphery of the plurality of coils to spray water on an outer surface of the plurality of coils along the entire coil depth thereof; and a plurality of air inlet openings located in the housing at various locations to allow ambient air to contact the plurality of coils generally along the entire coil depth to reduce an airflow pressure drop of the heat exchanger; and the plurality of coils include at least one coil having a different diameter and/or a different spacing between vertically adjacent coils than the remaining coils.

11. The heat exchanger of claim 10, wherein the plurality of coils comprise stacked spiral coils.

12. The heat exchanger of claim 10, wherein each of the plurality of coils is positioned within the housing by a plurality of posts which extend generally upwardly from the base such that a weight of the plurality of coils is supported by the substantially entirely by the base of the housing.

13. The heat exchanger of claim 12, wherein each of the plurality of coils is located on a framework that engages at least one of the plurality of posts.

14. The heat exchanger of claim 10, wherein the plurality of coils comprises at least two cooling circuits.

15. The heat exchanger of claim 10, wherein the base comprises fork lift support rails.

16. The heat exchanger of claim 14, wherein the housing comprises inner and outer sidewalls that define a passage therebetween.

17. The heat exchanger of claim 10, wherein the housing includes a moisture recovery device which generally prevents water from being blown out of the housing.

* * * * *

UNITED STATES PATENT AND TRADEMARK OFFICE

CERTIFICATE OF CORRECTION

PATENT NO. : 7,255,156 B2
APPLICATION NO. : 10/894715
DATED : August 14, 2007
INVENTOR(S) : Calton et al.

It is certified that error appears in the above-identified patent and that said Letters Patent is hereby corrected as shown below:

At column 3, line 26, after the word "FIG.", delete "23" and insert therefor --25--.

At column 3, line 33, after the word "spacer", delete "halve" and insert therefor --half--.

At column 3, line 54, after the word "FIG.", delete "4" and insert therefor --41--.

At column 7, line 44, before the word "substantially", delete "support" and insert --supported--.

At column 7, line 61, after the word "assembly", delete "then" and insert therefor --than--.

At column 8, line 6, after the word "halves", delete "233, 234" and insert therefor --234, 235--.

At column 8, line 9, after the word "halves", delete "233, 234" and insert therefor --234, 235--.

At column 8, line 11, after the words "abrade or", delete "knick" and insert therefor --nick--.

At column 8, lines 11 & 12, after the word "halves", delete "233, 234" and insert therefor --234, 235--.

UNITED STATES PATENT AND TRADEMARK OFFICE

CERTIFICATE OF CORRECTION

PATENT NO. : 7,255,156 B2
APPLICATION NO. : 10/894715
DATED : August 14, 2007
INVENTOR(S) : Calton et al.

It is certified that error appears in the above-identified patent and that said Letters Patent is hereby corrected as shown below:

At claim 7, column 10, line 65, after the word "circumferential", delete "neither" and insert therefor --periphery--.

At claim 12, column 12, line 23, delete the first occurrence of "by the".

Signed and Sealed this

Twenty-seventh Day of May, 2008

JON W. DUDAS
*Director of the United States Patent and Trademark Office*